US010923854B2

(12) United States Patent
Tanaka et al.

(10) Patent No.: US 10,923,854 B2
(45) Date of Patent: Feb. 16, 2021

(54) CONNECTOR AND CONNECTOR ASSEMBLY

(71) Applicant: Molex, LLC, Lisle, IL (US)

(72) Inventors: Daiki Tanaka, Yamato (JP); Yuji Naito, Yamato (JP); Mei Naito, Yamato (JP); Shigetoshi Yamaguchi, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/201,548

(22) Filed: Nov. 27, 2018

(65) Prior Publication Data

US 2019/0165513 A1 May 30, 2019

(30) Foreign Application Priority Data

Nov. 29, 2017 (JP) ..... JP2017-229490

(51) Int. Cl.

| | |
|---|---|
| ***H01R 13/627*** | (2006.01) |
| ***H01R 13/631*** | (2006.01) |
| *H01R 12/79* | (2011.01) |
| *H01R 12/78* | (2011.01) |

(Continued)

(52) U.S. Cl.

CPC ..... *H01R 13/6273* (2013.01); *H01R 13/6275* (2013.01); *H01R 13/631* (2013.01); *H01R 12/7029* (2013.01); *H01R 12/716* (2013.01); *H01R 12/78* (2013.01); *H01R 12/79* (2013.01)

(58) Field of Classification Search

CPC ..... H01R 12/16; H01R 12/17; H01R 12/18; H01R 12/7029; H01R 12/716; H01R 12/71; H01R 13/627; H01R 13/11; H01R 23/68

See application file for complete search history.

(56) References Cited

U.S. PATENT DOCUMENTS 5,545,051 A * 8/1996 Summers ..... H01R 12/716 439/350
5,626,482 A * 5/1997 Chan ..... H01R 12/716 439/74

(Continued)

FOREIGN PATENT DOCUMENTS

CN 105322369 A 2/2016
CN 106025710 A 10/2016

(Continued)

*Primary Examiner* — Abdullah A Riyami
*Assistant Examiner* — Nader J Alhawamdeh

(57) ABSTRACT

A connector body includes mating guide parts formed on each longitudinal end and mating with counterpart mating guide parts formed on both longitudinal ends of a counterpart connector body of a counterpart connector. Each reinforcing bracket includes a pair of left/right slide guides disposed on the mating guide parts and being engageable with a pair of left/right slide engagement parts of a counterpart reinforcing bracket mounted to a counterpart mating guide part. One reinforcing bracket further includes a receiving member capable of emerging/submerging. When the counterpart mating guide part is mated with the mating guide part, the receiving member submerges. When the slide engagement part engages with the slide guide and the counterpart mating guide part slides on the mating guide part, the receiving member emerges and latches the counterpart mating guide part.

10 Claims, 14 Drawing Sheets

(51) Int. Cl.
*H01R 12/71* (2011.01)
*H01R 12/70* (2011.01)

(56) References Cited

U.S. PATENT DOCUMENTS 6,116,949 A * 9/2000 Costello ..... H01R 13/6485 439/509
6,855,004 B2 * 2/2005 Soh ..... H01L 23/60 439/41
6,955,546 B1 * 10/2005 Huang ..... H01R 13/5213 439/135
7,074,085 B2 * 7/2006 Chen ..... H01R 13/658 439/607.36
7,232,317 B2 * 6/2007 Ookura ..... H01R 13/506 439/660
7,367,816 B2 * 5/2008 Liu ..... H01R 13/26 439/74
7,748,994 B1 * 7/2010 Peng ..... H01R 12/716 439/660
7,922,499 B2 * 4/2011 Liao ..... H01R 12/714 439/660
8,272,881 B2 * 9/2012 Miyazaki ..... H01R 12/716 439/345
8,292,635 B2 * 10/2012 Little ..... H01R 12/7029 439/570
8,845,339 B2 * 9/2014 Ono ..... H01R 12/7052 439/74
8,992,233 B2 * 3/2015 Miyazaki ..... H01R 12/707 439/74
9,362,637 B2 * 6/2016 Hasegawa ..... H01R 12/716
9,728,882 B1 * 8/2017 Nakazawa ..... H01R 12/716
10,249,969 B2 * 4/2019 Ono ..... H01R 12/7011
2004/0018756 A1 * 1/2004 Pan ..... H01R 13/6271 439/74
2010/0130068 A1 * 5/2010 Peng ..... H01R 13/2457 439/660
2010/0190383 A1 * 7/2010 Yamada ..... H01R 12/716 439/680
2011/0165797 A1 * 7/2011 Takeuchi ..... H01R 12/716 439/660
2011/0250800 A1 * 10/2011 Guo ..... H01R 12/716 439/660
2013/0012074 A1 * 1/2013 Mashiyama ..... H01R 12/73 439/660
2013/0023162 A1 * 1/2013 Harlan ..... H01R 24/60 439/660
2013/0280926 A1 * 10/2013 Ono ..... H01R 12/712 439/65
2014/0227899 A1 8/2014 Tanaka et al.
2014/0227910 A1 * 8/2014 Tanaka ..... H01R 12/7052 439/626
2015/0207248 A1 * 7/2015 Takenaga ..... H01R 12/716 439/74
2019/0165513 A1 * 5/2019 Tanaka ..... H01R 13/6273

FOREIGN PATENT DOCUMENTS

CN 109038013 B 1/2020
JP H04-368783 A 12/1992
TW 201813212 A 4/2018

* cited by examiner

CONNECTOR AND CONNECTOR ASSEMBLY

RELATED APPLICATIONS

This application claims priority to Japanese Application No. 2017-229490, filed Nov. 29, 2017, which is incorporated herein by reference in its entirety.

TECHNICAL FIELD

The present disclosure relates to a connector and a connector assembly.

BACKGROUND ART

Conventionally, connectors such as board to board connectors, etc., have been used to electrically connect pairs of parallel circuit boards to each other. Such connectors are attached to each of the mutually facing surfaces on pairs of circuit boards and are mated so as to be conductively connected. Proposed is an art which ensures that a state of electrical connection is kept even when the connector is subjected to external force or the like (for example, refer to patent document 1).

FIG. 14 is a partial cross-sectional view of a conventional connector.

In the figure, 811 is a first housing as the housing of a first connector mounted to first circuit board 891, and 911 is a second housing as the housing of a second connector mounted to second circuit board 991. A plurality of first terminals 861 are disposed on first housing 811, and a plurality of second terminals 961 which are in contact with first terminals 861, are disposed on second housing 911.

Further, first housing 811 has, disposed thereon, lock levers 851 for locking second housing 911 mated with this first housing 811. This lock levers 851 include springs 853, and, by the elongation force of springs 853 when first housing 811 and second housing 911 are mated, distal end parts 852 of lock levers 851 advance into and engage with engagement holes 951 formed on second housing 911. As a result, first housing 811 and second housing 911 stay mated with each other and are securely maintained in an electrically connected state even when being subjected to external force or the like.

Patent Document 1: JP H04-368783 A

SUMMARY

However, in the aforementioned conventional connector, only one engagement hole 951 and one distal end part 852 of lock lever 851, which mutually engage, are disposed on each of the left and right of first housing 811 and second housing 911. For this reason, the engaged state of engagement holes 951 and distal end parts 852 of lock levers 851 is released and the mated state of first housing 811 and second housing 911 is released if external force is received from a direction oblique with respect to the mating direction of first housing 811 and second housing 911, for example, if second circuit board 991 is urged against first circuit board 891.

An objective of this disclosure is to solve the problem of the aforementioned conventional connector and provide a highly reliable connector and a connector assembly wherein the connector is securely locked to the mated counterpart connector and securely stays mated with the counterpart connector.

To achieve this objective, the connector includes a connector body, terminals mounted to this connector body, and reinforcing brackets mounted to each of two ends in the longitudinal direction of the connector body. The connector body includes mating guide parts formed on the two ends in the longitudinal direction, this mating guide parts mating with counterpart mating guide parts formed on the two ends in the longitudinal direction of the counterpart connector body of the counterpart connector. Each reinforcing bracket includes a pair of left and right slide guides disposed on the mating guide part, this slide guides being capable of engaging with a pair of left and right slide engagement parts of a counterpart reinforcing bracket mounted to a counterpart mating guide part. One of the reinforcing brackets further includes a receiving member capable of emerging and submerging. When the counterpart mating guide part is mated with the mating guide part, the receiving member submerges, and when the slide engagement part engages with the slide guide and the counterpart mating guide part slides on the mating guide part, the receiving member emerges and latches a counterpart mating guide part.

In another connector, the receiving member is a cantilevered flat plate and the mating guide part includes a receiving-member storing recess from and in which the receiving member can emerge and submerge.

In yet another connector, the receiving member is capable of elastically deforming in a mating direction. When the counterpart mating guide part is mated with the mating guide part, the receiving member receives force in the mating direction applied by the counterpart mating guide part and submerges in the receiving-member storing recess, and when the force in the mating direction is released, at least a free end thereof protrudes from the receiving-member storing recess toward a reverse mating direction.

In yet another connector, each of the reinforcing brackets further includes a pair of side plate parts extending in the longitudinal direction of the connector body, and a pair of side wall guide parts connected to each of this side plate parts. Each of this side wall guide parts includes a slide guide extending in the sliding direction of the counterpart mating guide part and a slide stopping part extending in a direction orthogonal to the sliding direction. The counterpart mating guide part stops sliding when the slide engagement part engaged with the slide guide abuts against the slide stopping part.

In yet another connector, each of the side wall guide parts further includes a latching recess formed on the connection portion of the slide guide and the slide stopping part. When abutting against the slide stopping part, the slide engagement part is latched in the latching recess.

In yet another connector, one of the reinforcing brackets further includes side plate extension parts extending each of the side plate parts, and the receiving members are connected to each of this side plate extension parts.

In yet another connector, one of the reinforcing brackets further includes side plate extension parts extending each of the side plate parts, and the receiving member is connected to one of this side plate extension parts.

The connector assembly includes the connector of the present disclosure and a counterpart connector, wherein the counterpart connector includes a counterpart connector body having counterpart mating guide parts formed on the two ends in a longitudinal direction and having counterpart reinforcing brackets mounted, the counterpart mating guide parts mating with the mating guide parts of this connector and the counterpart reinforcing brackets having a pair of left and right slide engagement parts.

The connector according to the present disclosure is securely locked to the mated counterpart connector. Consequently, the mating of the connector and the counterpart connector is securely maintained and reliability improves.

BRIEF DESCRIPTION OF THE DRAWINGS

FIGS. 1A and 1B are perspective views of the first connector according to the first embodiment, wherein FIG. 1A is a view from the mating face side and FIG. 1B is a view from the mounting face side.

FIGS. 3A and 3B are two surface views of the first connector according to the first embodiment, wherein FIG. 3A is a top view and FIG. 3B is a side view.

FIGS. 4A and 4B are perspective views of the second connector according to the first embodiment, wherein FIG. 4A is a view from the mating face side and FIG. 4B is a view from the mounting face side.

FIGS. 7A and 7B are two surface views illustrating the state in which the first connector and the second connector according to the first embodiment are mated but not locked, wherein FIG. 7A is a plan view, and FIG. 7B is a side cross-sectional view along the line A-A seen from arrows A in FIG. 7A.

FIGS. 8A and 8B are enlarged cross-sectional views illustrating the state in which the first connector and the second connector according to the first embodiment are mated but not locked, wherein FIG. 8A is a cross-sectional view along the line B-B seen from arrows B in FIG. 7A and FIG. 8B is a cross-sectional view along the line C-C seen from arrows C in FIG. 7A.

FIGS. 10A and 10B are two surface views illustrating the state in which the first connector and the second connector according to the first embodiment are mated and locked, wherein FIG. 10A is a plan view, and FIG. 10B is a side cross-sectional view along the line D-D seen from arrows D in FIG. 10A.

FIGS. 11A and 11B are main-part enlarged views illustrating the state in which the first connector and the second connector according to the first embodiment are mated but not locked, wherein FIG. 11A is a main-part perspective view of FIG. 9 and FIG. 11B is a cross-sectional view along the line E-E seen from arrows E in FIG. 10A.

FIGS. 12A and 12B are perspective views of the first connector according to the second embodiment, wherein FIG. 12A is a view from the mating face side and FIG. 12B is a view from the mounting face side.

DETAILED DESCRIPTION OF THE PREFERRED EMBODIMENTS

Embodiments will be described in detail below with reference to the drawings.

Figure 1A:
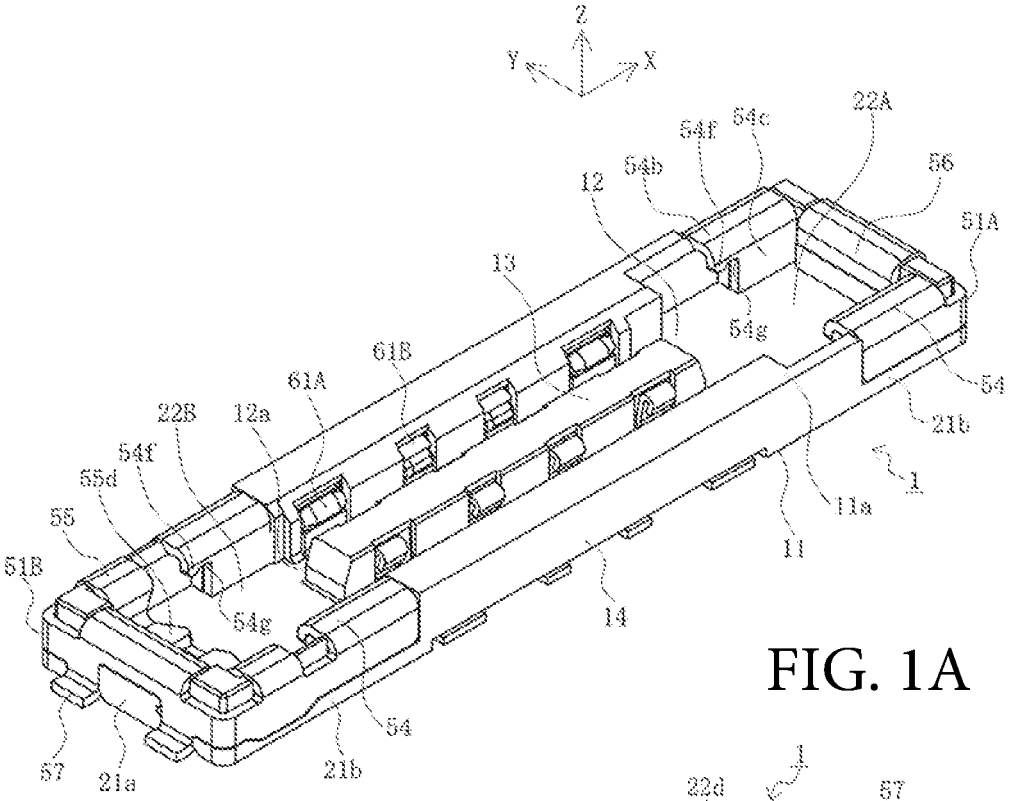
Figure 1B:
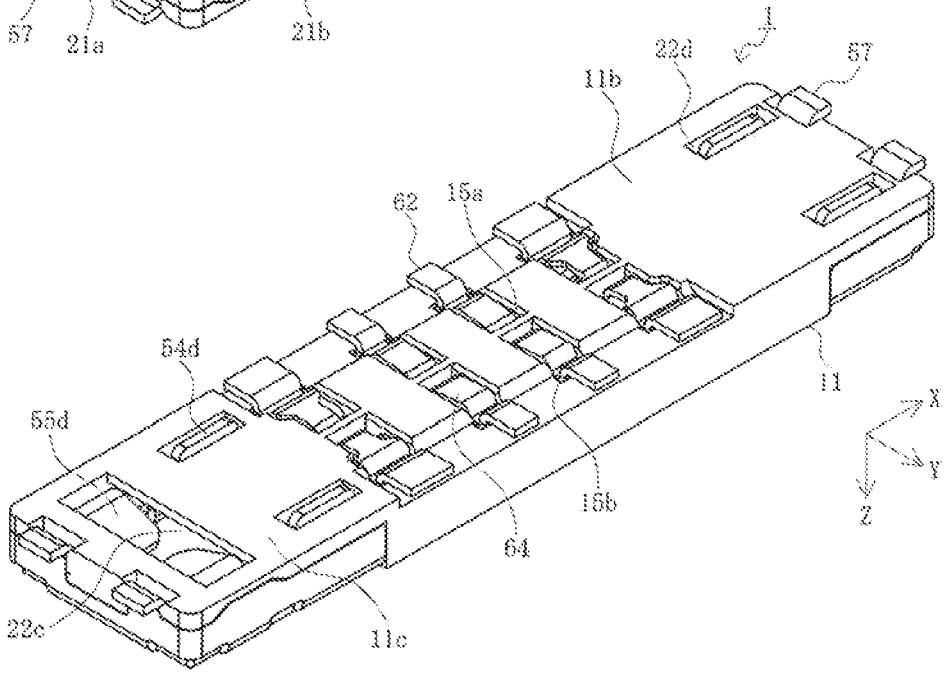
Figure 2:
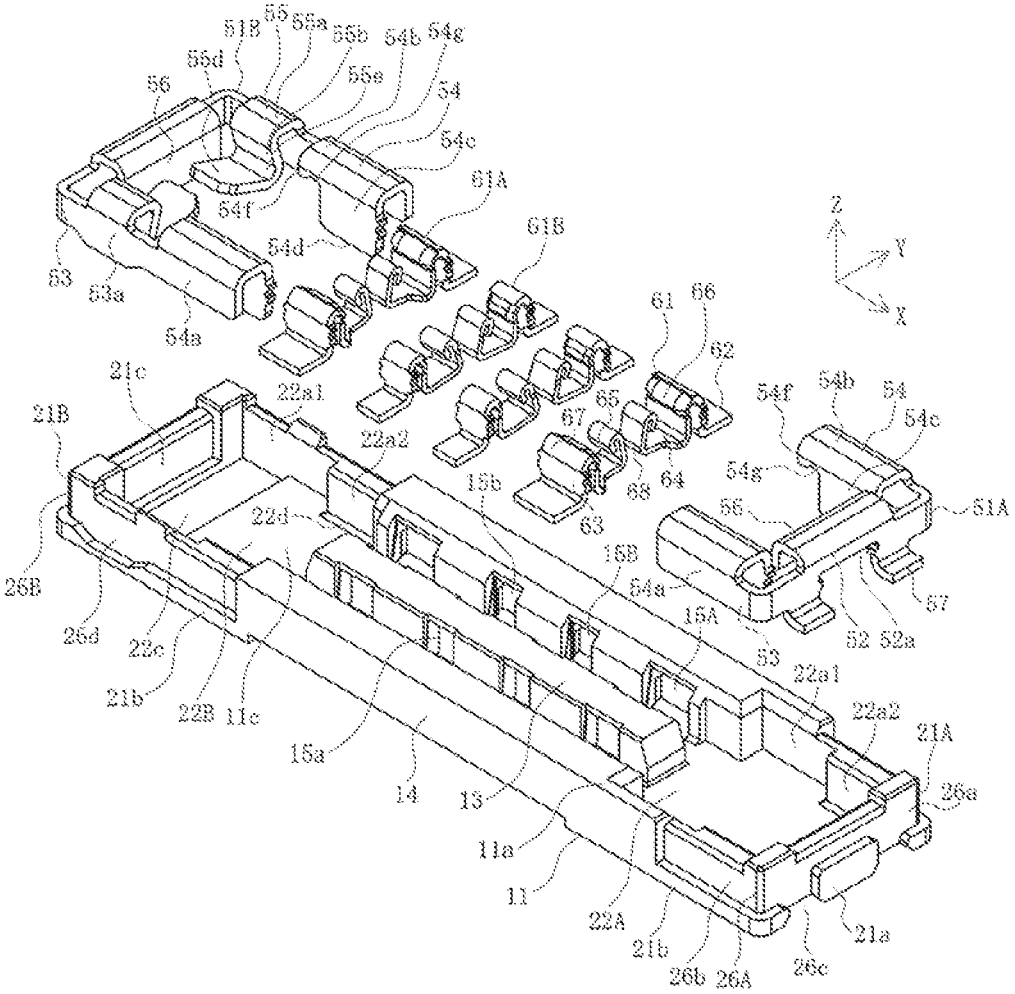
FIG. 2 is an exploded view of the first connector according to the first embodiment.
Figure 3A:
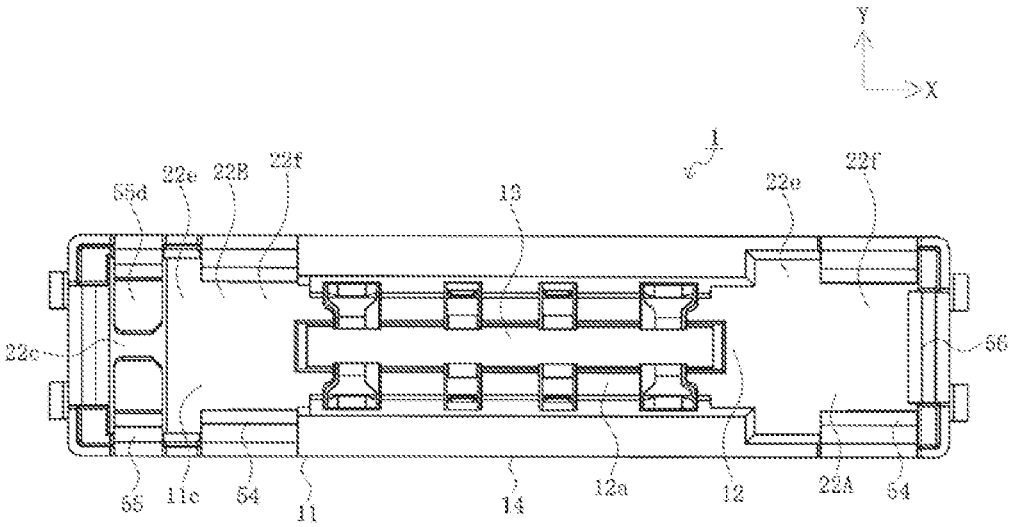
Figure 3B:
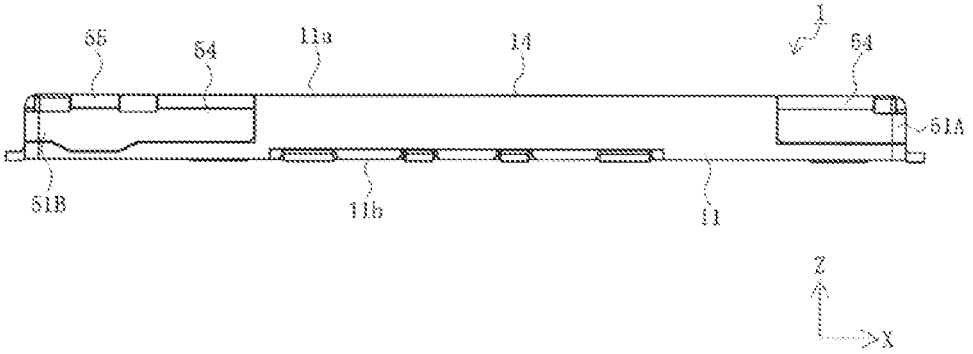

FIGS. 1A and 1B are perspective views of the first connector according to the first embodiment, FIG. 2 is an exploded view of the first connector according to the first embodiment, and FIGS. 3A and 3B are two surface views of the first connector according to the first embodiment. Note that, FIG. 1A is a view from the mating face side and FIG. 1B is a view from the mounting face side. FIG. 3A is a top view and FIG. 3B is a side view.

In the figure, 1 is a connector of the present embodiment and is a first connector serving as one of a pair of board to board connectors, this pair being a connector assembly. This first connector 1 is a surface mount type connector mounted on the surface of a first substrate not illustrated in the drawings and serving as a mounting member, and is mated to second connector 101 serving as a counterpart connector explained later. Furthermore, this second connector 101 is the other of the pair of board to board connectors and is a surface mount type connector mounted on the surface of a second substrate not illustrated in the drawings and serving as a mounting member.

Note that while first connector 1 and second connector 101, which constitute the connector assembly of the present embodiment, are ideally used for electrically connecting the first substrate and the second substrate as substrates, the connectors can also be used to electrically connect other members. Examples of the first substrate and second substrate include printed circuit boards, flexible flat cables (FFC), flexible printed circuit boards (FPC), etc. used in electronic equipment, etc., but may be any type of substrate.

Furthermore, expressions for indicating directions such as up, down, left, right, front, and back, used to describe the operations and configurations of the parts of first connector 1 and second connector 101 in the present embodiment are not absolute but rather relative directions, and though appropriate when the parts of first connector 1 and second connector 101 are in the positions illustrated in the figures, these directions should be interpreted differently when these positions change, to correspond to this change.

Furthermore, first connector 1 has first housing 11 as a connector body integrally formed of an insulating material such as a synthetic resin. As is illustrated in the figure, this first housing 11 is a substantially rectangular body having a substantially rectangular thick plate shape, wherein a substantially rectangular recess 12 the periphery of which is enclosed, is formed on the side into which second connector 101 is fitted, that is, on the mating face 11*a* side (positive Z-axis direction side), this recess 12 being mated with second housing 111 explained later. First connector 1 has, for example, dimensions of a length of approximately 11 [mm], a width of approximately 2.5 [mm], and a thickness of approximately 1 [mm], but it is possible to change the dimensions as appropriate. Further, first projection 13 serving as an island part mating with recessed groove part 113 explained later, is formed integrally with first housing 11 in recess 12, and, on the two sides in the Y-axis direction of first projection 13, side wall parts 14 extending in parallel to this first projection 13 are formed integrally with first housing 11.

In this case, first projection 13 and side wall parts 14 protrude upward (positive Z-axis direction) from the bottom face of recess 12 and extend in the longitudinal direction (X-axis direction) of first housing 11. Thereby, recessed groove parts 12*a* which are elongated recesses extending in the longitudinal direction of first housing 11, are formed on the two sides of first projection 13 as parts of recess 12.

On the side faces on the two sides of first projection 13, first-terminal storing inner cavities 15*a* are formed. Further, on the side faces on the inner side of side wall parts 14, first-terminal storing outer cavities 15*b* are formed. First-terminal storing inner cavities 15*a* and first-terminal storing outer cavities 15*b* are linked by the bottom faces of recessed groove parts 12*a* and thus integrated with each other. Therefore, when being described in a collective manner, first-terminal storing inner cavities 15*a* and first-terminal storing outer cavities 15*b* are described as first-terminal storing cavities 15.

In the present embodiment, first-terminal storing cavities 15 are formed side by side in the longitudinal direction of first housing 11 on the two sides in the width direction (Y-axis direction) of this first housing 11. Specifically, a plurality thereof are formed at a predetermined pitch on each of the two sides of first projection 13. A plurality of first terminals 61, which are stored in each of first-terminal storing cavities 15 and mounted to first housing 11, are also disposed at a similar pitch on each of the two sides of first projection 13.

Further, first terminals 61 stored in each of first-terminal storing cavities 15 are present in two types, namely wide-width first terminals 61A and narrow-width first terminals 61B. Therefore, first-terminal storing cavities 15 are also present in two types, namely wide-width first-terminal storing cavities 15A storing wide-width first terminals 61A and narrow-width first-terminal storing cavities 15B storing narrow-width first terminals 61B. Wide-width first-terminal storing cavities 15A are formed at each of the two end sides in the longitudinal direction of each row on the two sides in the width direction of first housing 11, and narrow-width first-terminal storing cavities 15B are formed in each row between wide-width first-terminal storing cavities 15A at the two ends. For convenience of explanation, two narrow-width first-terminal storing cavities 15B each are formed on the two sides of first projection 13 in the example illustrated in the figure. However, the number thereof may be one each, three or more each, or may be set arbitrarily.

Note that, because wide-width first-terminal storing cavities 15A and narrow-width first-terminal storing cavities 15B have a similar configuration aside from the width dimension (the dimension in the X-axis direction), they will be described as first-terminal storing cavities 15 when being described collectively. Further, because wide-width first terminals 61A and narrow-width first terminals 61B have a similar configuration aside from the width dimension (the dimension in the X-axis direction), they will be described as first terminals 61 when being described collectively.

First terminal 61 is a member integrally formed by carrying out processing such as punching and bending on a conductive metal plate, and includes held part 63, tail part 62 one end of which is connected to the bottom end of this held part 63, and elastically deformable contact arm part 68 one end of which is connected to the top end of held part 63. This contact arm 68 is a plate member bent substantially in a U-shape and specifically includes upper connection part 67 connected to the top end of held part 63, a second contact part 66 formed in the vicinity of the inward end of this upper connection part 67, lower connection part 64 connected to this second contact part 66, and first contact part 65 formed in the vicinity of the free end of this lower connection part 64.

Held part 63 extends in the up/down direction (Z-axis direction), that is, in the thickness direction of first housing 11, and is the portion fitted into and held in first-terminal storing outer cavity 15*b*. Further, tail part 62 is bent and connected to held part 63, extends in the left/right direction (Y-axis direction), that is, outward in the width direction of first housing 11, and is connected by soldering or the like to a connection pad linked to a conductive trace of the first substrate.

Moreover, upper connection part 67 extends from held part 63 inward in the width direction of first housing 11. Specifically, upper connection part 67 is bent and connected to held part 63 and extends inward in the width direction of first housing 11. On the inner end of upper connection part 67, second contact part 66 is formed, this second contact part 66 being bent downward and curved so as to protrude inward in the width direction of first housing 11. Further, lower connection part 64 is a portion connected to the bottom end of second contact part 66 and including a U-shaped side face. In the vicinity of the free end, that is, in the vicinity of the top end on the inner side of lower connection part 64, first contact part 65 is formed, this first contact part 65 being bent in a U-shape and curved so as to protrude outward in the width direction of first housing 11.

First terminal 61 is fitted from mounting face 11*b*, which is the downside face (the face in the negative Z-axis direction) of first housing 11, into first-terminal storing cavity 15, and fixed to first housing 11 by held part 63 being sandwiched from both sides by the side walls of first-terminal storing outer cavity 15*b* formed on the side face on the inner side of side wall part 14. In this state, that is, in the state in which first terminal 61 is mounted to first housing 11, first contact part 65 and second contact part 66 are positioned on both the left and right sides of recessed groove part 12*a* and face each other.

Note that, because first terminal 61 is a member integrally formed by carrying out processing on a metal plate, first terminal 61 is elastic to a certain degree. Further, as is obvious from the shape thereof, the clearance between first contact part 65 and second contact part 66 which face each other, is elastically deformable. That is, when second terminal 161, which is explained later, of second connector 101 is inserted between first contact part 65 and second contact part 66, the clearance between first contact part 65 and second contact part 66 elastically expands as a result.

Moreover, all first terminals 61, that is, both wide-width first terminals 61A and narrow-width first terminals 61B, have an identical vertical cross-sectional shape, that is, the cross-sectional shape along the axial line extending from the free end of tail part 62 via held part 63 up to the free end of contact arm part 68. Consequently, the electrical length from tail part 62 to the contact portion with second terminal 161 becomes equal in all first terminals 61.

Moreover, first protruding end part 21, which is a mating guide part, is disposed on each of the two ends in the longitudinal direction of first housing 11. Here, the one positioned on the front end (the end in the positive X-axis direction) side of first housing 11 is named first protruding end part 21A, and the one positioned at the rear end (the end in the negative X-axis direction) side of first housing 11 is named first protruding end part 21B, and when being described collectively, first protruding end part 21A and first protruding end part 21B are described as first protruding end part 21. On first protruding end part 21A, mating recess 22A is formed as a part of recess 12, and, on first protruding end part 21B, mating recess 22B is formed as a part of recess 12. Mating recess 22A is connected to the front end in the longitudinal direction (the end in the positive X-axis direction) of each recessed groove part 12*a*, and mating recess 22B is connected to the rear end in the longitudinal direction (the end in the negative X-axis direction) of each recessed groove part 12*a*. Mating recess 22A and mating recess 22B both are substantially rectangular recesses and described as mating recess 22 when being described collectively. Second protruding end part 122, which is explained later, of this second connector 101 is inserted into this mating recess 22 in a state in which first connector 1 and second connector 101 are mated.

Note that, as is illustrated in FIG. 3A, mating recess 22 includes wide-width part 22*e* wherein the dimension in the width direction (Y-axis direction) of first housing 11 is relatively large, and narrow-width part 22*f* wherein the dimension in the width direction of first housing 11 is smaller than that of this wide-width part 22*e*. Further, both in mating recess 22A and in mating recess 22B, wide-width part 22*e* and narrow-width part 22*f* are disposed side by side in the longitudinal direction (X-axis direction) so that wide-width part 22*e* is positioned on the rear side and narrow-width part 22*f* is positioned on the front side. Consequently, a pair of inner wall faces 22*a* positioned on the two sides in the width direction of first housing 11 in mating recess 22 are also disposed side by side in the longitudinal direction so that wide-width inner wall face 22*a*1 is positioned on the rear side and narrow-width inner wall face 22*a*2 is positioned on the front side. Further, lock storing recess 22*c* as a receiving-member storing recess is formed on wide-width part 22*e* in mating recess 22B. In the example illustrated in the figure, lock storing recess 22*c*, which is a through-hole, penetrates bottom plate part 11*c* of first housing 11 in the thickness direction and reaches up to mounting face 11*b*, but it does not necessarily have to be a through-hole and may be a recess formed so as to be indented downward (negative Z-axis direction) from bottom plate part 11*c*. Moreover, latching-leg storing hole 22*d*, which is through-hole penetrating bottom plate part 11*c* in the thickness direction and reaching up to mounting face 11*b*, is formed at a location adjacent to narrow-width inner wall face 22*a*2 on the bottom face of mating recess 22.

In addition, first protruding end part 21 includes side-wall extension parts 21*b* extending in the longitudinal direction of first housing 11 from both sides in the longitudinal direction of side wall part 14, and end wall parts 21*a* extending in the width direction at the outer side on the two ends in the longitudinal direction of first housing 11.

Further, first reinforcing bracket 51 as reinforcing bracket is attached to first protruding end part 21. This first reinforcing bracket 51 is stored and held in first-bracket holding recess 26 formed on the outer perimeter of first protruding end part 21. First reinforcing bracket 51 is present in two types, namely first reinforcing bracket 51A attached to first protruding end part 21A and first reinforcing bracket 51B attached to first protruding end part 21B, and first-bracket holding recess 26 is present as first-bracket holding recess 26A formed on first protruding end part 21A and first-bracket holding recess 26B formed on first protruding end part 21B. When being described collectively, first reinforcing bracket 51A and first reinforcing bracket 51B are described as first reinforcing bracket 51, and first-bracket holding recess 26A and first-bracket holding recess 26B are described as first-bracket holding recess 26.

This first-bracket holding recess 26 has an outer-end-part storing part 26*a* formed on end wall part 21*a* of first housing 11, side-plate-part storing cavity 26*b* formed on side-wall extension part 21*b* of first housing 11, and leg-part storing cavity 26*c* extending from the bottom end of outer-end-part storing part 26*a* downward (negative Z-axis direction) and reaching mounting face 11*b*. Note that, on side-plate-part storing cavity 26*b* of first-bracket holding recess 26B, the dimension in the longitudinal direction (X-axis direction) of first housing 11 is formed so as to be larger than that of side-plate-part storing cavity 26*b* of first-bracket holding recess 26A, and side-plate-part storing cavity 26*b* of first-bracket holding recess 26B includes extension-side-plate-part storing cavity 26*d*.

First reinforcing bracket 51 is a member integrally formed by carrying out processing such as punching and bending on a metal plate, and includes first body part 52 as an elongated belt-like body part extending in the width direction of first housing 11, a pair of first side plate parts 53 as side plate parts that are bent and connected to the outer end of this first body part 52 in the width direction of first housing 11 and extend in the reverse body part direction, which is the longitudinal direction of first housing 11 in the direction moving away from first body part 52 (the direction toward the center in the longitudinal direction of first housing 11), a pair of side wall guide parts 54 connected to the distal ends of this first side plate parts 53, center guide part 56 connected to the top end of first body part 52, a pair of connection leg parts 57 connected to the bottom end of first body part 52, and engagement recess 52*a* formed on first body 52.

First reinforcing brackets 51 have a horizontally flipped C-shape when seen from the mating face 11*a* side, and are stored in each first-bracket holding recess 26. Specifically, first body part 52 is stored in outer-end-part storing part 26*a*, end wall part 21*a* enters and engages with engagement recess 52*a*, and connection leg part 57 is stored in leg-part storing cavity 26*c*. Note that the bottom end of connection leg part 57 is exposed on mounting face 11*b* and connected by soldering or the like to a connection pad formed on the surface of the first substrate. Further, center guide part 56 is attached to the upper side of end wall part 21*a* so as to cover the top face of end wall part 21*a* and inner end wall face 21*c* on the inner side of mating recess 22 on end wall part 21*a*.

In addition, side wall guide part 54 has guide side plate part 54*a* the proximal end of which is connected to the distal end of first side plate part 53, guide curved part 54*b* the proximal end of which is connected to the top end of this guide side plate part 54*a* and which is curved in such a manner that the distal end is oriented downward along narrow-width inner wall face 22*a*2 on the inner side of mating recess 22, and guide inner side plate part 54*c* as a flat plate-shaped slide stopping part which is connected to the bottom end of this guide curved part 54*b* and extends downward along narrow-width inner wall face 22*a*2. Note that guide connection end 54*d*, which is the bottom end of this guide inner side plate part 54*c*, is inserted into latching-leg storing hole 22*d*, is exposed on mounting face 11*b* and connected by soldering or the like to a connection pad formed on the surface of the first substrate.

In first reinforcing bracket 51A, the distal end of guide curved part 54*b* protrudes more to the reverse body part direction (negative X-axis direction side) than the side end in the reverse body part direction of guide inner side plate part 54*c*. Further, the portion on the inner side of mating recess 22 on the portion protruding in the reverse body part direction of guide curved part 54*b* functions as slide guide 54*f*. Note that it is desirable that lock latching recess 54*g* as a latching recess indented upward (positive Z-axis direction) be formed on the connection portion with the side end in the reverse body part direction of guide inner side plate part 54*c* on this slide guide 54*f*.

Meanwhile, in first reinforcing bracket 51B, side plate extension part 53*a* is interposed between first side plate part 53 and guide side plate part 54*a*. That is, side plate extension part 53*a* is connected to the distal end of first side plate part 53, and guide side plate part 54*a* is connected to the distal end of this side plate extension part 53*a*. Note that the dimensions in the front/rear direction (X-axis direction) of first side plate part 53 and guide side plate part 54*a* on first reinforcing bracket 51A are equal to those of first side plate part 53 and guide side plate part 54*a* on first reinforcing bracket 51B. Consequently, the dimension from the proximal end of first side plate part 53 to the distal end of guide side plate part 54*a* on first reinforcing bracket 51B is, just by the dimension of side plate extension part 53*a*, larger than the dimension from the proximal end of first side plate part 53 to the distal end of guide side plate part 54*a* on first reinforcing bracket 51A.

Further, to each top end of the pair of left and right side plate extension parts 53*a*, stopper holding part 55 is connected as a receiving member holding part. This stopper holding part 55 has upper curved part 55*a* the proximal end of which is connected to the top end of side plate extension part 53*a* and which is curved in such a manner that the distal end is oriented downward on the inner side of mating recess 22, flat plate-shaped side arm part 55*b* which is connected to the bottom end of this upper curved part 55*a* and extends downward on the inner side of wide-width inner wall face 22*a*1, and stopper member 55*d* as a cantilever-like flat plate-shaped receiving member connected to the bottom end of this side arm part 55*b* with lower curved part 55*e* therebetween. In an initial state in which no load is applied, stopper holding part 55 has a shape such that the distal end of stopper member 55*d* is oriented obliquely upward, and a part of lower curved part 55*e* is stored in lock storing recess 22*c*, but the major portion including the distal end of stopper member 55*d* is positioned above lock storing recess 22*c* in a position higher than the top face of bottom plate part 11*c* in mating recess 22B. Stopper holding part 55 has spring properties, and when a downward load is applied from above to stopper member 55*d*, stopper holding part 55 elastically deforms, and thereby the entirety of stopper member 55*d* is stored in lock storing recess 22*c*. Note that the dimensions of stopper members 55*d* related to the width direction of first housing 11 are set to a level such that there is no mutual contact even in a state in which a load is applied and the entirety of the pair of left and right stopper members 55*d* are stored in lock storing recess 22*c*.

Further, in first reinforcing bracket 51B, the proximal end of guide curved part 54*b* protrudes more in the body part direction (negative X-axis direction) than the side end in the body part direction of guide inner side plate part 54*c*, and the bottom end of the portion of this guide curved part 54*b* protruding in the body part direction functions as slide guide 54*f*. Note that it is desirable that lock latching recess 54*g* indented upward be formed on the connection portion with the side end in the body part direction of guide inner side plate part 54*c* on this slide guide 54*f* In this way, slide guide 54*f* of first reinforcing bracket 51A and slide guide 54*f* of first reinforcing bracket 51B in the present embodiment both protrude in the same direction (negative X-axis direction).

Note that, in a state in which first reinforcing brackets 51 are attached to first protrusions 21, as is illustrated in FIG. 3B, the height of the top faces of side wall guide part 54, stopper holding part 55 and center guide part 56 is substantially the same as that of mating face 11*a* of first housing 11.

Next, the configuration of second connector 101 will be described.

Figure 4A:
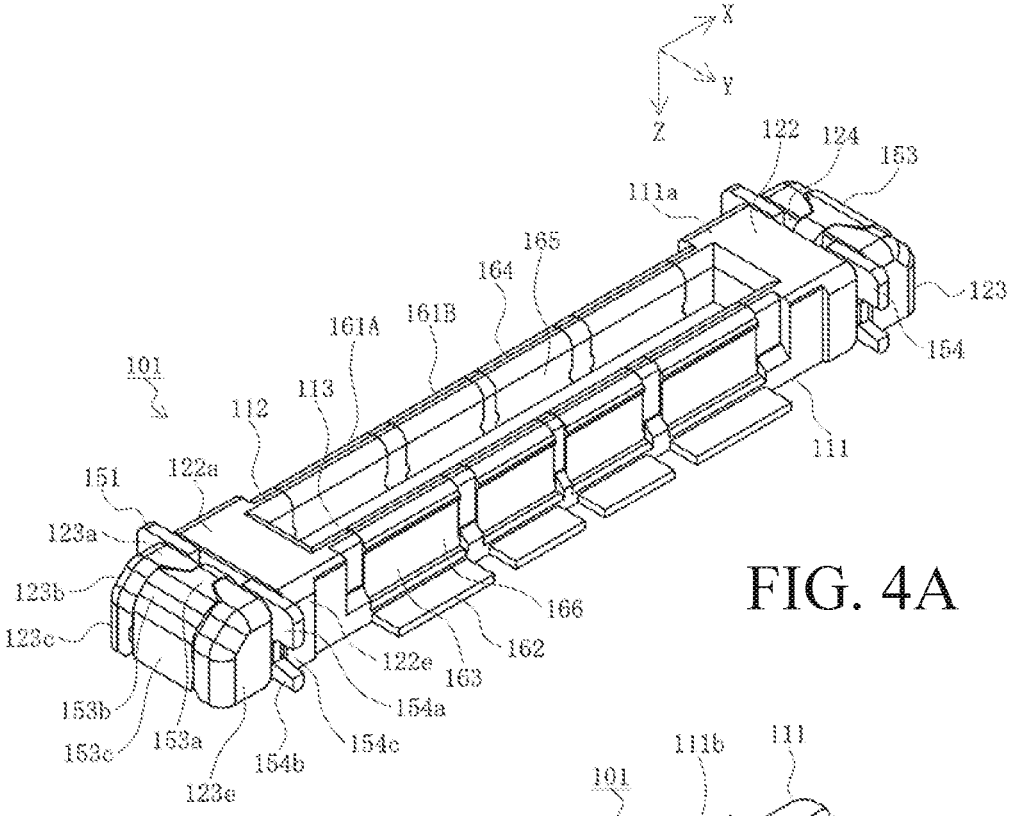
Figure 4B:
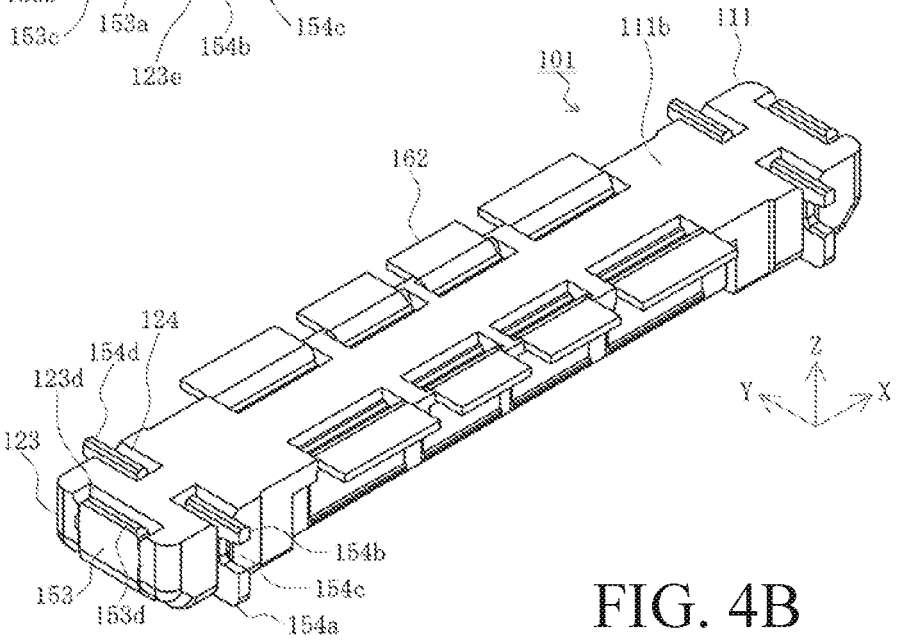
Figure 5:
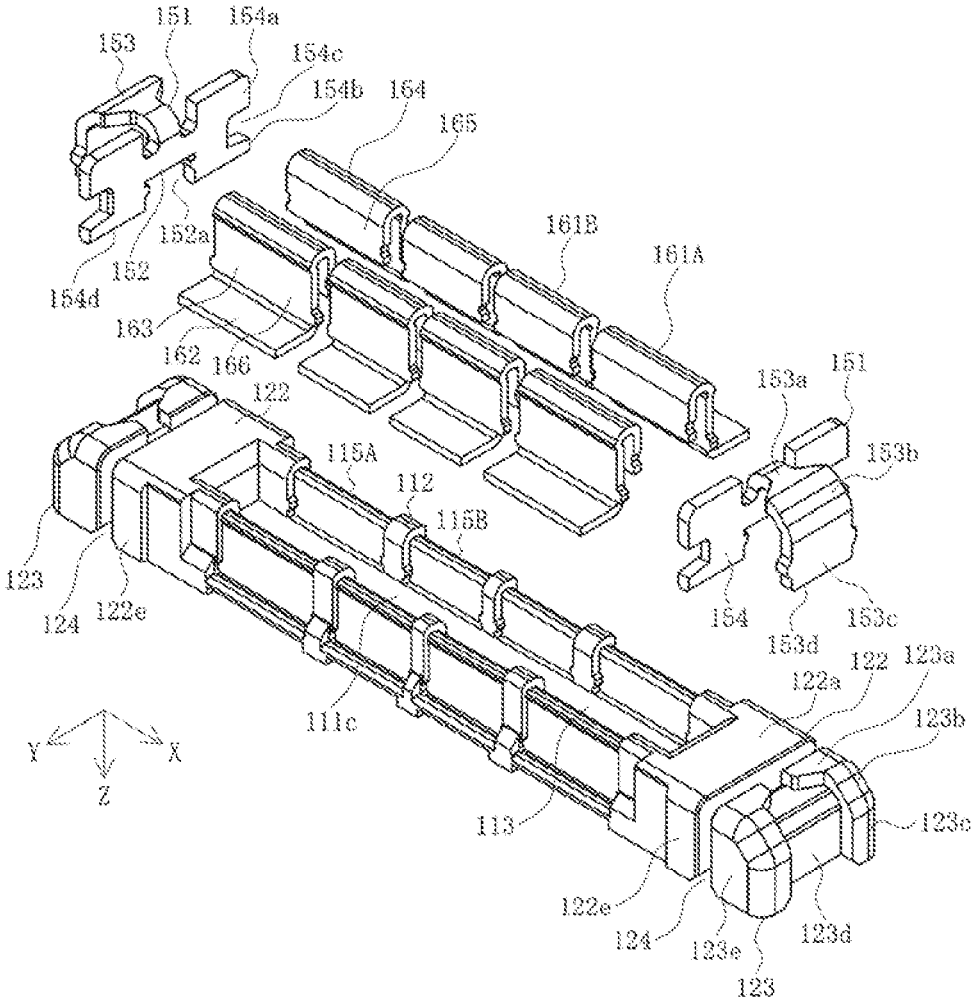
FIG. 5 is an exploded view of the second connector according to the first embodiment.

FIGS. 4A and 4B are perspective views of the second connector according to the first embodiment, and FIG. 5 is an exploded view of the second connector according to the first embodiment. Note that, FIG. 4A is a view from the mating face side and FIG. 4B is a view from the mounting face side.

Second connector 101 has second housing 111 as a counterpart connector body integrally formed of an insulating material such as a synthetic resin. As is illustrated in the figure, this second housing 111 is a substantially rectangular body with the shape of a substantially rectangular thick plate. Integrally formed on the side of second housing 111 into which first connector 1 is fitted, that is, the mating face 111*a* side (negative Z-axis direction side) are elongated recessed groove part 113 extending in the longitudinal direction (X-axis direction) of second housing 111, and second projections 112 as elongated projections that define the outer side of recessed groove part 113 and extend in the longitudinal direction of second housing 111. This second projections 112 are formed along the two sides of recessed groove part 113 and also along the two sides of second housing 111.

Further, each second projection 112 includes recessed groove-shaped second-terminal storing cavities 115 formed so as to continuously straddle the side face on the inner side of second projection 112, the top face of second projection 112 and the side face on the outer side of second projection 112. Second terminals 161 as counterpart terminals are stored and mounted in this second-terminal storing cavities 115. As is illustrated in the figure, recessed groove part 113 is closed by bottom plate part 111*c* on the side mounted to the second substrate, that is, on the mounting face 111*b* side (positive Z-axis direction side).

In the present embodiment, second-terminal storing cavities 115 are formed side by side in the longitudinal direction of second housing 111 on the two sides in the width direction (Y-axis direction) of this second housing 111. Specifically, a plurality thereof are formed at a predetermined pitch on each of second projections 112. A plurality of second terminals 161, which are stored in each of second-terminal storing cavities 115, are also disposed at a similar pitch on each of second projections 112.

Further, second terminals 161 stored in each of second-terminal storing cavities 115 are present in two types, namely wide-width second terminals 161A and narrow-width second terminals 161B. Therefore, second-terminal storing cavities 115 are also present in two types, namely wide-width second-terminal storing cavities 115A storing wide-width second terminals 161A and narrow-width second-terminal storing cavities 115B storing narrow-width second terminals 161B. Wide-width second-terminal storing cavities 115A are formed at each of the two end sides in the longitudinal direction of each row on the two sides in the width direction of second housing 111, and narrow-width second-terminal storing cavities 115B are formed in each row between wide-width second-terminal storing cavities 115A at the two ends. For convenience of explanation, two narrow-width second-terminal storing cavities 115B each are formed on both second projections 112 in the example illustrated in the figure. However, the number thereof may be one each, three or more each, or may be set arbitrarily.

Note that, because wide-width second-terminal storing cavities 115A and narrow-width second-terminal storing cavities 115B have a similar configuration aside from the width dimension (the dimension in the X-axis direction), they will be described as second-terminal storing cavities 115 when being described collectively. Further, because wide-width second terminals 161A and narrow-width second terminals 161B have a similar configuration aside from the width dimension (the dimension in the X-axis direction), they will be described as second terminals 161 when being described collectively.

This second terminal 161 is a member integrally formed by carrying out processing such as punching and bending on a conductive metal plate, and includes held part 163, tail part 162 connected to the bottom end of this held part 163, connection part 164 connected to the top end of held part 163, first contact part 165 connected to the inward end of this connection part 164, and second contact part 166 formed on the outer surface of held part 163. Note that, of second terminal 161, the portion except for tail part 162 substantially has a U-shape.

Further, second terminal 161 is fitted from mating face 111*a* side into second-terminal storing cavity 115 and fixed to second housing 111 by held part 163 being stored in the portion formed on the side face on the outer side of second projection 112 in second-terminal storing cavity 115 and being sandwiched from both sides by the side walls thereof.

In this state, that is, in the state in which second terminal 161 is mounted to second housing 111, the surfaces of first contact part 165, connection part 164, and second contact part 166 are in a state of being exposed on the mating face and each side face of second projection 112. Further, tail part 162 extends toward the outside of second housing 111 and is connected by soldering or the like to a connection pad linked to a conductive trace on the second substrate.

Further, because first contact part 165 and second contact part 166 are fixed to second housing 111 so as to sandwich second projection 112 from both sides, neither can effectively be displaced in the width direction of second housing 111 and the clearance therebetween is invariable. That is, even if second terminal 161 is inserted between first contact part 65 and second contact part 66 of first terminal 61, first contact part 165 and second contact part 166 effectively are not displaced in the width direction of second housing 111 and first contact part 65 and second contact part 66 are elastically displaced.

Moreover, all second terminals 161, that is, both wide-width second terminals 161A and narrow-width second terminals 161B, have an identical vertical cross-sectional shape, that is, the cross-sectional shape along the axial line extending from the free end of tail part 162 via held part 163 up to the distal end of first contact part 165. Consequently, the electrical length from tail part 162 to the contact portion with first terminal 61 becomes equal in all second terminals 161.

Moreover, second protruding end part 122, which is a counterpart mating guide part, is disposed on each of the two ends in the longitudinal direction of second housing 111. This second protruding end part 122 is a thick member extending in the width direction (Y-axis direction) of second housing 111 and having the two ends thereof connected to the two ends in the longitudinal direction of each second projection 112, and includes top face part 122*a* substantially flush with mating face 111*a*, and, on both the left and right sides, side face parts 122*e* extending in the longitudinal direction (X-axis direction) of second housing 111. Further, in the state in which first connector 1 and second connector 101 are mated, second protruding end part 122 functions as an insertion projection inserted into mating recess 22 of first protruding end part 21 contained in first connector 1.

Moreover, second protruding end 122 includes extreme end part 123 protruding outward at the two ends in the longitudinal direction of second housing 111, and second bracket holding recess 124 formed adjacently to this extreme end part 123. Extreme end part 123 includes top face part 123*a* substantially flush with top face part 122*a*, and, on both the left and right sides, side face parts 123*e* substantially flush with side face parts 122*e*, and further includes end wall face part 123*c* orthogonal to top face part 123*a* and side face parts 123*e*, and inclination-changing face part 123*b* connecting top face part 123*a* and end wall face part 123*c*. This inclination-changing face part 123*b* is a curved face or a combination of a plurality of flat faces, and the angle of the outer face thereof progressively changes from a state of being flush with top face part 123*a* to a state of being flush with end wall face part 123*c*. Further, storage recess 123*d* formed on extreme end part 123 is formed in such a manner that the bottom face thereof is substantially parallel to top face part 123*a*, inclination-changing face part 123*b* and end wall face part 123*c*.

Further, second reinforcing bracket 151 as a counterpart reinforcing bracket is attached to second protruding end part 122. This second reinforcing bracket 151 is a member integrally formed by carrying out processing such as punching and bending on a conductive metal plate, and includes second body part 152 extending in the width direction of second housing 111, a pair of lock plate parts 154 connected to both the left and right ends of second body part 152, and extreme-end cover part 153 connected to the top end of second body part 152.

Second body part 152 includes engagement recess 152*a* and is inserted into second bracket holding recess 124, and engagement recess 152*a* engages with an engagement part in second bracket holding recess 124. As a result, second bracket 151 is attached to second protruding end part 122.

Each lock plate part 154 has main protruding pieces 154*a* and auxiliary protruding pieces 154*b* protruding outward in the width direction of second housing 111, and cutout parts 154*c* as slide engagement parts formed between main protruding pieces 154*a* and auxiliary protruding pieces 154*b*. Further, in a state in which second reinforcing bracket 151 is attached to second protruding end part 122, main protruding pieces 154*a* and auxiliary protruding pieces 154*b* protrude more to the outer side in the width direction of second housing 111 than side face parts 122*e* of second protruding end part 122 and side face parts 123*e* of extreme end part 123, and the bottom parts of cutout parts 154*c* are in a state of being substantially flush with side face parts 122*e* and side face parts 123*e*. Note that the bottom end of each lock plate part 154 is lock connection end 154*d*, and, in a state in which second reinforcing bracket 151 is attached to second protruding end part 122, is exposed from the mounting face 111*b* side end of second bracket holding recess 124, to mounting face 111*b*, and is connected by soldering or the like to a connection pad formed on the surface of the second substrate. Note that cutout parts 154*c* are the portions into which slide guides 54*f* of first reinforcing bracket 51 enter and are latched, and main protruding pieces 154*a* are the portions which enter into and are latched by lock latching recesses 54*g* of first reinforcing bracket 51.

Further, extreme-end cover part 153 includes top face part 153*a*, inclination-changing face part 153*b*, and end wall face part 153*c* the outer surface of which changes similarly to top face part 123*a*, inclination-changing face part 123*b*, and end wall face part 123*c* of extreme end part 123, respectively. Moreover, in a state in which second reinforcing bracket 151 is attached to second protruding end part 122, extreme-end cover part 153 is stored in storage recess 123*d*, and top face part 153*a*, inclination-changing face part 153*b*, and end wall face part 153*c* are in a state of being substantially flush with top face part 123*a*, inclination-changing face part 123*b* and end wall face part 123*c* of extreme end part 123. Note that the bottom end of extreme-end cover part 153 is cover connection end 153*d*, and, in a state in which second reinforcing bracket 151 is attached to second protruding end part 122, is exposed from the mounting face 111*b* side end of storage recess 123*d*, to mounting face 111*b*, and is connected by soldering or the like to a connection pad formed on the surface of the second substrate.

The operation for mating first connector 1 and second connector 101 having the abovementioned configuration will be described next.

Figure 6:
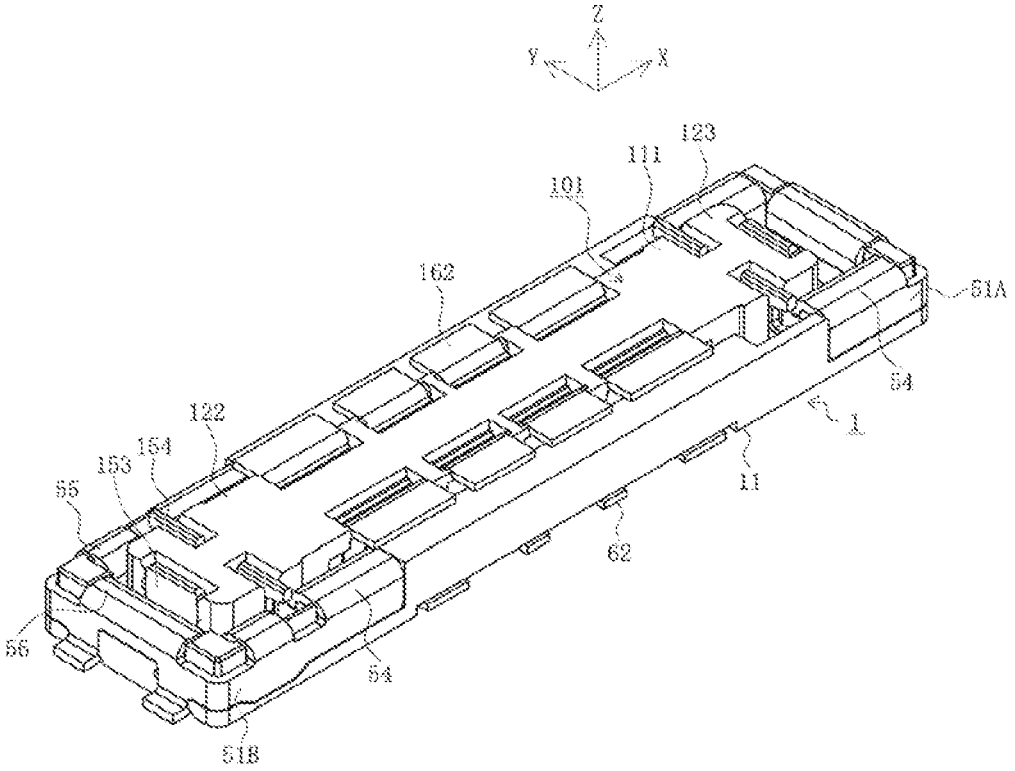
FIG. 6 is a perspective view illustrating a state in which the first connector and the second connector according to the first embodiment are mated but not locked.
Figure 7A:
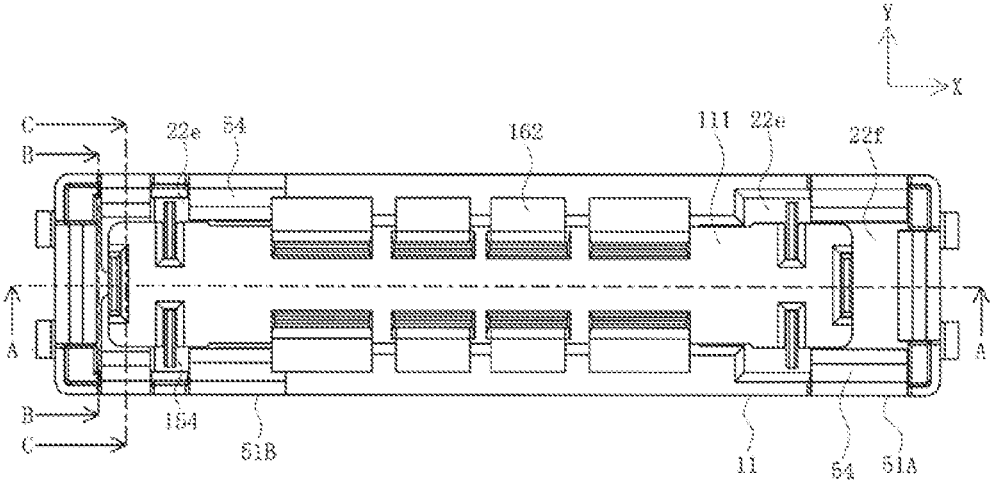
Figure 7B:
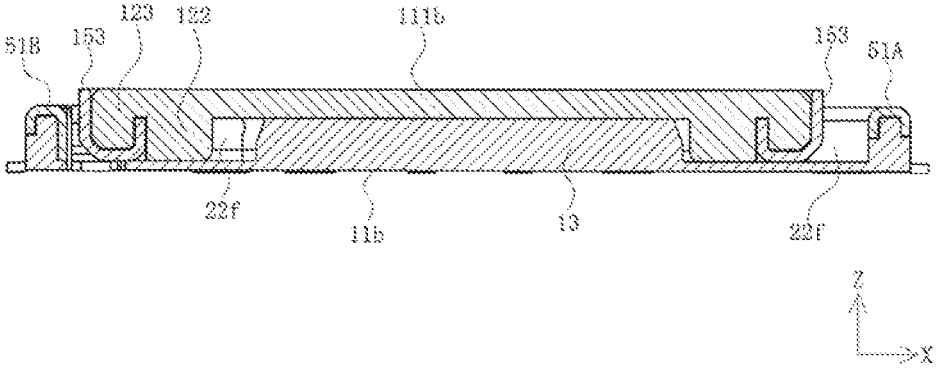
Figure 8A:
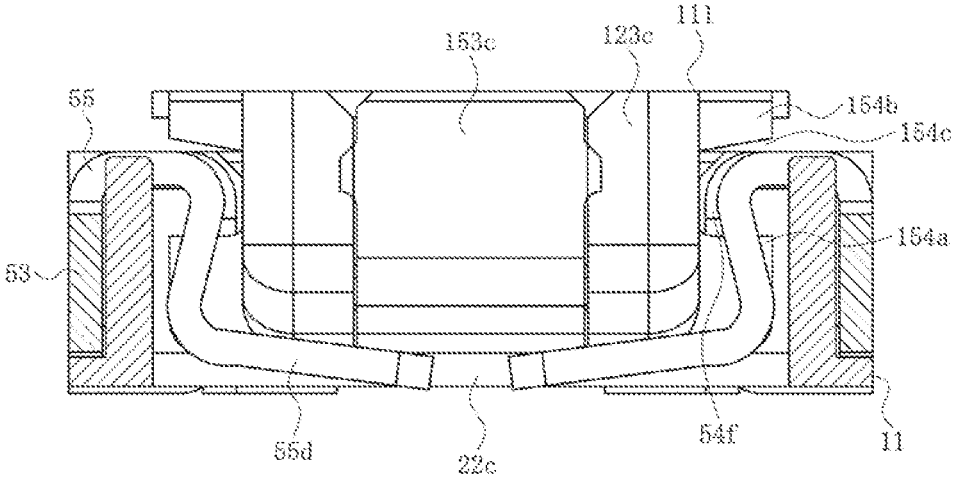
Figure 8B:
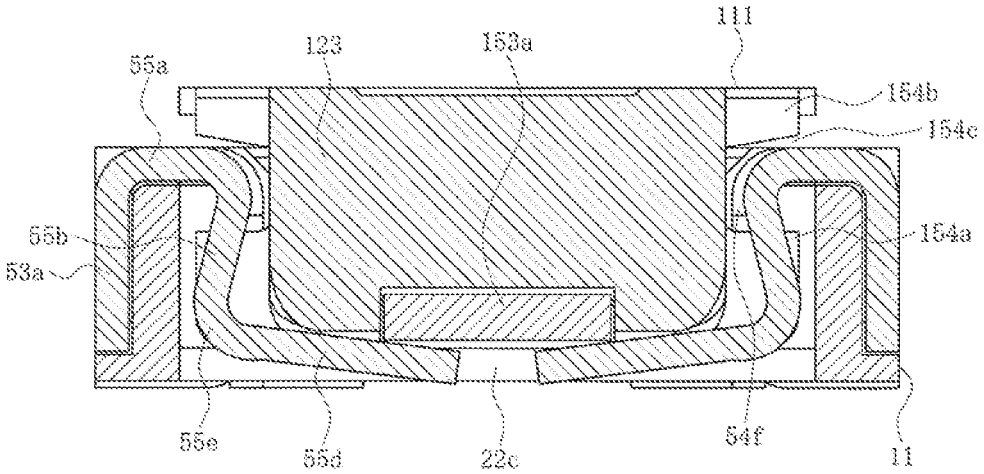
Figure 9:
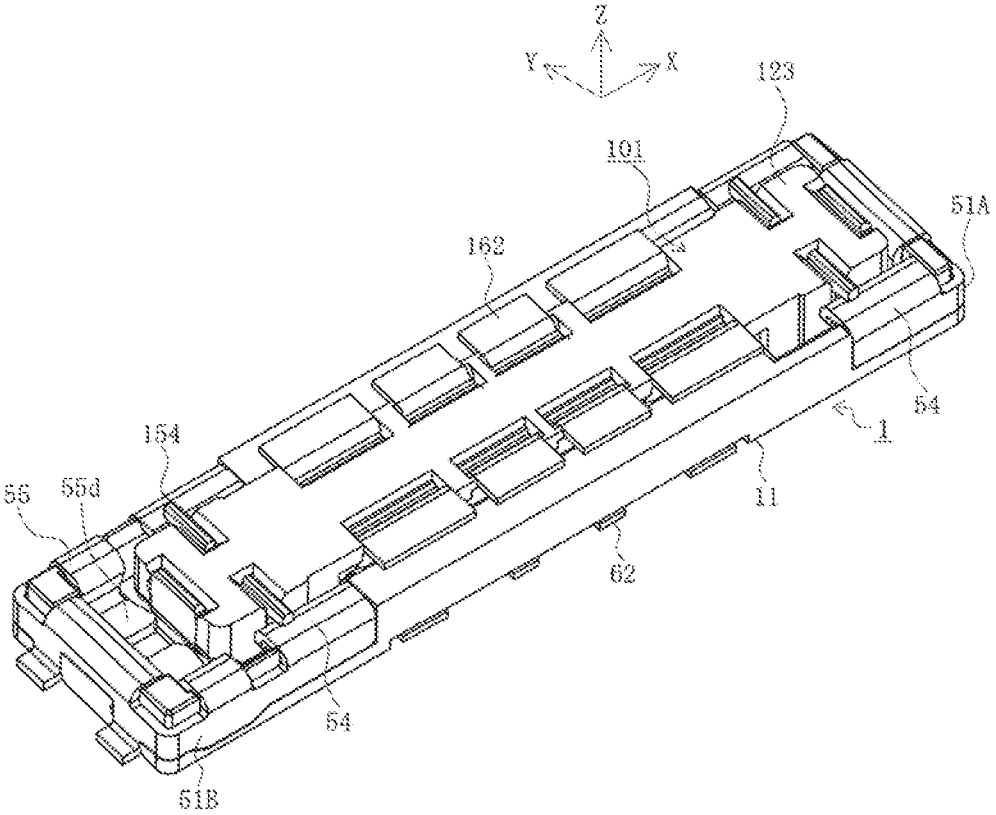
FIG. 9 is a perspective view illustrating a state in which the first connector and the second connector according to the first embodiment are mated and locked.
Figure 10A:
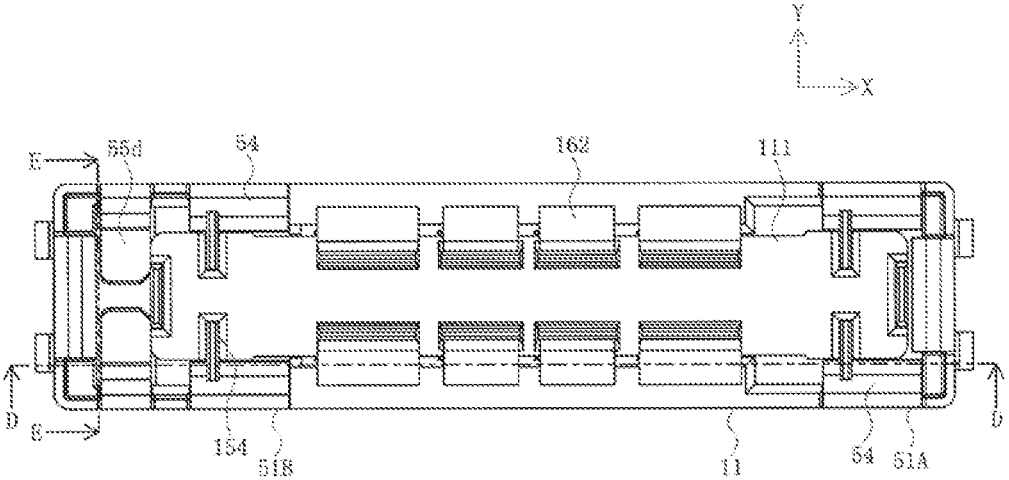
Figure 10B:
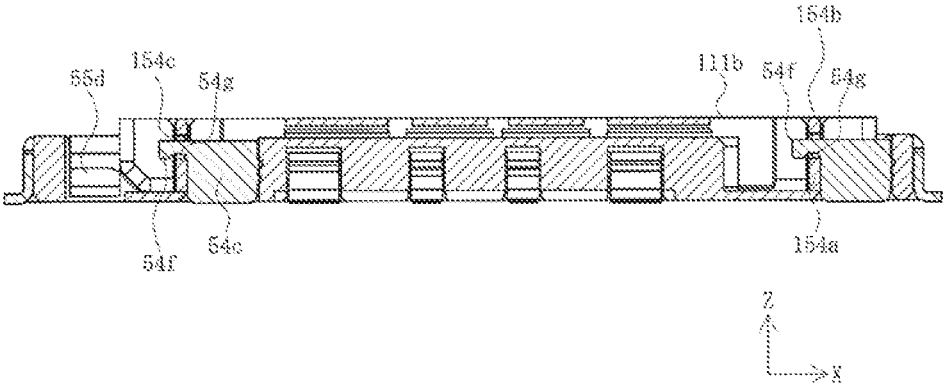
Figure 11A:
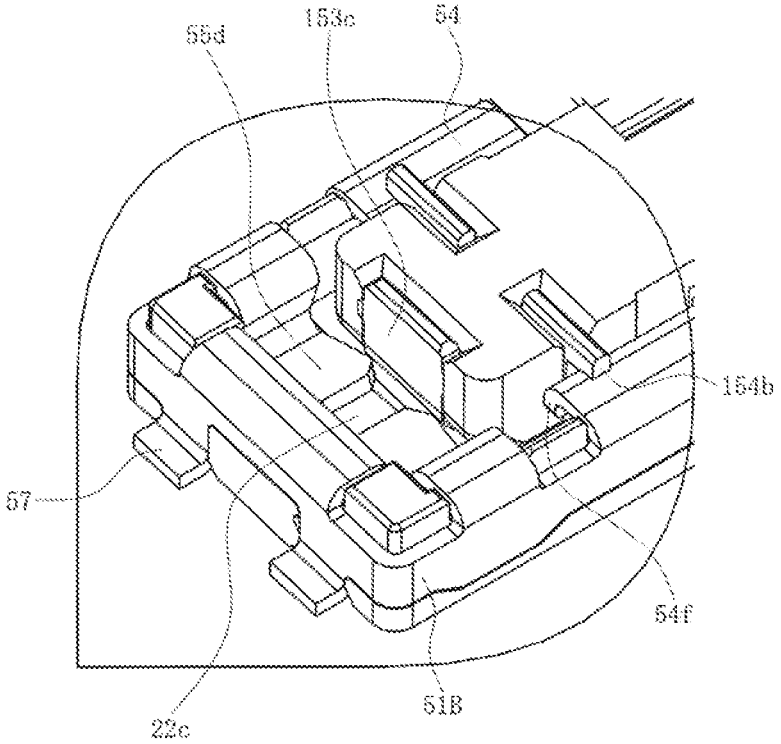
Figure 11B:
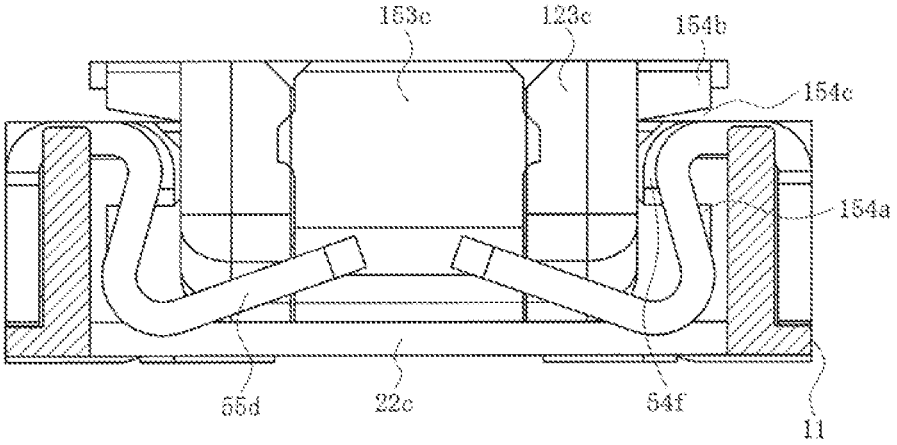

FIG. 6 is a perspective view illustrating the state in which the first connector and the second connector according to the first embodiment are mated but not locked, FIGS. 7A and 7B are two surface views illustrating the state in which the first connector and the second connector according to the first embodiment are mated but not locked, FIGS. 8A and 8B are enlarged cross-sectional views illustrating the state in which the first connector and the second connector according to the first embodiment are mated but not locked, FIG. 9 is a perspective view illustrating a state in which the first connector and the second connector according to the first embodiment are mated and locked, FIGS. 10A and 10B are two surface views illustrating a state in which the first connector and the second connector according to the first embodiment are mated and locked, and FIGS. 11A and 11B are main-part enlarged views illustrating a state in which the first connector and the second connector according to the first embodiment are mated but not locked. Note that, FIG. 7A is a plan view and FIG. 7B is a side cross-sectional view along the line A-A seen from arrows A in FIG. 7A). FIG. 8A is a cross-sectional view along the line B-B seen from arrows B in FIG. 7A and FIG. 8B is a cross-sectional view along the line C-C seen from arrows C in FIG. 7A. FIG. 10A is a plan view and FIG. 10B is a side cross-sectional view along the line D-D seen from arrows D in FIG. 10A, and, FIG. 11A is a main-part perspective view of FIG. 9 and FIG. 11B is a cross-sectional view along the line E-E seen from arrows E in FIG. 10A.

In the present embodiment, first terminals 61 and second terminals 161 may be connected to a signal line but may also be connected to a power line.

For example, all first terminals 61 and all second terminals 161 may be connected to a power line as parallel circuits. In this case, it will become possible to easily perform branch current calculation as the resistance value depends only on the width dimension, because wide-width first terminals 61A and narrow-width first terminals 61B have an identical vertical cross-sectional shape and an equal electrical length with the only difference being the width dimension, and likewise, wide-width second terminals 161A and narrow-width second terminals 161B have an identical vertical cross-sectional shape and an equal electrical length with the only difference being the width dimension. Further, because wide-width first terminals 61A and second terminals 161A, which generate a large amount of heat due to the high amperage therein, are present on the two end sides in the longitudinal direction of first housing 11 and second housing 111, it is easy to dissipate the heat to the outside, and it does not happen that heat accumulates inside of first connector 1 and second connector 101.

Further, it is, for example, possible to connect wide-width first terminals 61A and second terminals 161A to a power line and narrow-width first terminals 61B and second terminals 161B to a signal line. In this case, it will, for example, become possible to connect a power line from a cell mounted to an electronic device or the like, to wide-width first terminals 61A and second terminals 161A, and connect a signal line carrying a signal indicating an identification number, remaining power, temperature or the like of the cell, to narrow-width first terminals 61B and second terminals 161B. Further, because wide-width first terminals 61A and second terminals 161A connected to the power line are present on the two end sides in the longitudinal direction of first housing 11 and second housing 111, it is easy to dissipate heat to the outside, and it does not happen that heat accumulates inside of first connector 1 and second connector 101 also in this case.

Here, first connector 1 is made to be mounted to the surface of the first substrate, which is not illustrated in the drawings, by tail parts 62 of first terminals 61 being connected by soldering or the like to a connection pad linked to a conductive trace on the first substrate and by the bottom ends of connection leg parts 57 and guide connection ends 54*d* of side wall guide parts 54 of first reinforcing brackets 51 being connected by soldering or the like to the connection pad on the first substrate. Likewise, second connector 101 is made to be mounted to the surface of the second substrate, which is not illustrated in the drawings, by tail parts 162 of second terminals 161 being connected by soldering or the like to a connection pad linked to a conductive trace on the second substrate and by cover connection ends 153*d* of extreme-end cover parts 153 and lock connection ends 154*d* of lock plate parts 154 of second reinforcing brackets 151 being connected by soldering or the like to the connection pad on the second substrate.

Firstly, operator brings mating face 11*a* of first housing 11 of first connector 1 and mating face 111*a* of second housing 111 of second connector 101 into a state of facing each other, and the positional alignment of first connector 1 and second connector 101 is complete when the positions of second projections 112 on second connector 101 match the positions of the corresponding recessed groove parts 12*a* on first connector 1 and the positions of second protruding end parts 122 on second connector 101 match the positions of the corresponding mating recesses 22 on first connector 1. In more detail, the position of one second protruding end part 122 on second connector 101 is caused to correspond to a position close to first projection 13 of mating recess 22A in first protruding end part 21A of first connector 1, the position of the other second protruding end part 122 on second connector 101 is caused to correspond to a position close to inner end wall face 21*c* of mating recess 22B in first protruding end part 21B of first connector 1, and the positions of main protruding pieces 154*a* and auxiliary protruding pieces 154*b* protruding outward from both the left and right sides of second protruding end parts 122 are caused to correspond to the positions of wide-width parts 22*e* on mating recesses 22.

When first connector 1 and/or second connector 101 are, in this state, moved in the direction approaching the counterpart side, that is, in the mating direction, second projections 112 and second protruding end parts 122 of second connector 101 are inserted into recessed groove parts 12*a* and mating recesses 22 of first connector 1, as is illustrated in FIGS. 6, 7A-B and 8A-B, and first connector 1 and second connector 101 are mated. In more detail, main protruding pieces 154*a* and auxiliary protruding pieces 154*b* protruding outward from both the left and right sides of second protruding end part 122 are positioned in wide-width parts 22*e* of mating recesses 22, end wall face part 153*c* of extreme-end cover part 153 on one second protruding end part 122 of second connector 101 is far away from center guide part 56 of first reinforcing bracket 51A on first protruding end part 21A of first connector 1, and end wall face part 153*c* of extreme-end cover part 153 on the other second protruding end part 122 of second connector 101 is close or abuts to center guide part 56 of first reinforcing bracket 51B on first protruding end part 21B of first connector 1.

Further, as is illustrated in FIGS. 8A and 8B, stopper members 55*d* of first reinforcing bracket 51B are subjected to a downward (negative Z-axis direction) load, that is, a force in the mating direction, from top face part 123*a* of extreme end part 123 and/or top face part 153*a* of extreme-end cover part 153 on the other second protruding end part 122 of second connector 101, and therefore are elastically deformed and stored in lock storing recess 22*c*.

Moreover, when seen from the X-axis direction, slide guides 54*f* of first reinforcing brackets 51 are positioned in cutout parts 154*c* formed between main protruding pieces 154*a* and auxiliary protruding pieces 154*b* of lock plate parts 154, as is illustrated in FIGS. 8A and 8B. That is, in the thickness direction (Z-axis direction) of first housing 11, the positions of cutout parts 154*c* of lock plate parts 154 correspond to slide guides 54*f* of first reinforcing brackets 51.

Next, the operator slides first connector 1 and/or second connector 101 in the longitudinal direction (X-axis direction) of first housing 11 and second housing 111. Specifically, second connector 101 is caused to slide relatively to first connector 1 in the direction in which end wall face part 153*c* (which is far away from center guide part 56 of first reinforcing bracket 51A on first protruding end part 21A of first connector 1) of extreme-end cover part 153 on one second protruding end part 122 of second connector 101 approaches center guide part 56 of first reinforcing bracket 51A, that is, in the direction in which end wall face part 153*c* (which is close or abuts to center guide part 56 of first reinforcing bracket 51B on first protruding end part 21B of first connector 1) of extreme-end cover part 153 on the other second protruding end part 122 of second connector 101 moves away from center guide part 56 of first reinforcing bracket 51B.

As a result, slide guides 54*f* of first reinforcing bracket 51A and first reinforcing bracket 51B enter cutout parts 154*c* of lock plate parts 154 on both second protruding end parts 122 of second connector 101. Thereby, cutout parts 154*c* are latched by slide guides 54*f* at both second protruding end parts 122 of second connector 101, and therefore, it is prevented that first connector 1 and second connector 101 mutually move in the reverse mating direction (Z-axis direction) and it is prevented that the mated state of first connector 1 and second connector 101 is released.

Next, when the operator further slides first connector 1 and/or second connector 101 in the longitudinal direction of first housing 11 and second housing 111, top face part 123*a* of extreme end part 123 and/or top face part 153*a* of extreme-end cover part 153 on the other second protruding end 122 of second connector 101 come off/comes off from the top of stopper members 55*d* of first reinforcing bracket 51B, that is, the force in the mating direction is released, and therefore this stopper members 55*d* recover the posture of the initial state by their own spring properties and, as is illustrated in FIGS. 11A and 11B, the major portion including the distal end rise to a position higher than the top face of bottom plate part 11*c*. Thereby, stopper members 55*d* are in a state of latching end wall face part 123*c* of extreme end part 123 and/or end wall face part 153*c* of extreme-end cover part 153 on second protruding end 122, thus preventing first connector 1 and/or second connector 101 from sliding into the opposite direction. Therefore, it is prevented that the mated state of first connector 1 and second connector 101 is released.

Note that, because inclination-changing face part 123*b* and inclination-changing face part 153*b*, which have an outer face the angle of which progressively changes, are connected to top face part 123*a* of extreme end part 123 and top face part 153*a* of extreme-end cover part 153, stopper members 55 can smoothly rise along the outer faces/face of inclination-changing face part 123*b* and/or inclination-changing face 153*b* when extreme end part 123 and/or extreme-end cover part 153 on the other second protruding end part 122 of second connector 101 come off/comes off from the top of stopper members 55 of first reinforcing bracket 51B and stopper members 55*d* recover the posture of the initial state. Further, because, due to inclination-changing face part 123*b* and/or inclination-changing face part 153*b*, which have/has an outer face the angle of which progressively changes, the counterforce received by extreme end part 123 and/or extreme-end cover part 153 from the rising stopper members 55 includes a component force in the X-axis direction, and therefore the sliding of first connector 1 and/or second connector 101 is helped. Consequently, when sliding first connector 1 and/or second connector 101, the operator will, from half-way, feel as if the sliding is performed automatically and will be able to feel a good operability.

Further, when main protruding pieces 154*a* of lock plate parts 154 on both second protruding ends 122 of second connector 101 abut to the side ends in the reverse body part direction of guide inner side plate parts 54*c* of side wall guide parts 54 on first reinforcing brackets 51, the sliding of first connector 1 and/or second connector 101 is stopped, and the mating of first connector 1 and second connector 101 is completed.

In this state, each second terminal 161 on second connector 101 enterers between first contact part 65 and second contact part 66 of the corresponding first terminal 61 on first connector 1, and first contact part 165 and second contact part 166 of each second terminal 161 are in conducting contact with first contact part 65 and second contact part 66 of corresponding first terminal 61. At this time, first contact part 65 and second contact part 66 are sandwiching second terminal 161 from both sides by the function of contact arm part 68 as a spring part, and therefore first contact part 65 and second contact part 66 can maintain the contact state with first contact part 165 and second contact part 166 of second terminal 161. Consequently, it is possible to maintain the conducting state between first terminals 61 and second terminals 161 even if, when the electronic device or the like in which the first substrate and the second substrate are mounted falls down or receives external force, the generated vibration and shock are transmitted and second terminals 161 and first terminals 61 are relatively displaced in the width direction of first housing 11, and therefore, a phenomenon called instantaneous interruption in which conduction is temporarily blocked, does not occur.

Further, when main protruding pieces 154*a* of lock plate parts 154 enter and are latched in lock latching recesses 54*g* formed on the connection portions of slide guides 54*f* and guide inner side plate parts 54*c*, first connector 1 and second connector 101 are prevented from moving in the mutually reverse mating direction (Z-axis direction) and the mated state of first connector 1 and second connector 101 is prevented from being released. In addition, as was stated above, stopper members 55*d* having recovered the posture of the initial state by their own spring properties are in a state of latching end wall face part 123*c* of extreme end part 123 and/or end wall face part 153*c* of extreme-end cover part 153 on second protruding end 122, therefore first connector 1 and/or second connector 101 are/is prevented from sliding into the opposite direction and the mated state of first connector 1 and second connector 101 is prevented from being released.

Note that, if it is necessary to release the mating of first connector 1 and second connector 101, the operator uses, for example, a tool not illustrated in the drawings which has a pair of thin arm members like a pair of tweezers, to apply downward (negative Z-axis direction) force from above by the distal ends of the arm members to stopper members 55*d*, and store stopper members 55*d* in lock storing recess 22*c*. As a result, the latching of end wall face part 123*c* of extreme end part 123 and/or end wall face part 153*c* of extreme-end cover part 153 on second protruding end part 122 by stopper members 55*d* is released. Thereby, the operator can slide first connector 1 and/or second connector 101 in the opposite direction to release the mating of first connector 1 and second connector 101.

Further, it is possible to change the shape of stopper holding part 55 as appropriate. For example, it is also possible to omit side arm part 55*b* and lower curved part 55*e* and connect cantilever-like flat plate-shaped stopper member 55*d* to the bottom end of upper curved part 55*a*. In this case, in a state in which no load is applied, stopper members 55*d* are shaped in such a manner that the distal ends thereof are oriented obliquely downward and also toward the center in the width direction of first housing 11, and protrude inward from the two sides of mating recess 22. When second protruding end part 122 of second connector 101 is inserted into mating recess 22, stopper members 55*d* are pressed by side wall parts 123*e* on both the left and right sides of extreme end part 123, and therefore the distal end thereof is displaced to the outside in the width direction of first housing 11. Next, when first connector 1 and/or second connector 101 are caused to slide in the longitudinal direction of first housing 11 and second housing 111, and extreme end part 123 comes off stopper members 55*d*, this stopper members 55*d* recover the posture of the initial state, and the distal ends thereof protrude inward from the two sides of mating recess 22. As a result, stopper members 55*d* are in a state of latching end wall face part 123*c* of extreme end part 123 and/or end wall face part 153*c* of extreme-end cover part 153, thus preventing first connector 1 and/or second connector 101 from sliding into the opposite direction.

In this manner, first connector 1 according to the present embodiment includes first housing 11, first terminals 61 mounted to first housing 11, and first reinforcing brackets 51 mounted to each of the two ends in the longitudinal direction of first housing 11. First housing 11 includes first protruding end parts 21 formed on the two ends in the longitudinal direction, this first protruding end parts 21 mating with second protruding end parts 122 formed on the two ends in the longitudinal direction of second housing 111 of second connector 101. Each first reinforcing bracket 51 includes a pair of left and right slide guides 54*f* disposed on first protruding end part 21, this slide guides 54*f* being capable of engaging with a pair of left and right cutout parts 154*c* of second reinforcing bracket 151 mounted to second protruding end part 122. One first reinforcing bracket 51 further includes stopper members 55*d* capable of emerging and submerging. When second protruding end parts 122 are mated with first protruding end parts 21, stopper members 55*a* submerge, and when cutout parts 154*c* engage with slide guides 54*f* and second protruding end parts 122 slide on first protruding end parts 21, stopper members 55*d* emerge and latch second protruding end parts 122.

As a result, first reinforcing brackets 51, which include the pairs of left and right slide guides 54*f*, and second reinforcing brackets 151, which include the pairs of left and right cutout parts 154*c*, securely engage just by second protruding end parts 122 being mated with first protruding end parts 21 and second protruding end parts 122 being caused to slide on first protruding end parts 21. Therefore, first connector 1 and second connector 101 mated to each other are easily and securely locked in a short time, the mating state of first connector 1 and second connector 101 is securely maintained, and reliability improves.

Further, stopper members 55*d* are cantilevered flat plates, and first protruding end part 21 includes lock storing recess 22*c* from and in which stopper members 55*d* can emerge and submerge. Moreover, stopper members 55*d* are capable of elastically deforming in the mating direction. When second protruding end parts 122 are mated with first protruding end parts 21, stopper members 55*d* receive force in the mating direction applied by second protruding end part 122 and submerge in lock storing recess 22*c*, and when the force in the mating direction is released, at least the free ends thereof protrude from lock storing recess 22*c* toward the reverse mating direction. Consequently, although the configuration is simple, stopper members 55*d* function reliably, and, just by causing second protruding end parts 122 to slide on first protruding end parts 21, it is possible to prevent the sliding of second protruding end parts 122 in the opposite direction.

In addition, each first reinforcing bracket 51 includes a pair of first side plate parts 53 extending in the longitudinal direction of first housing 11, and a pair of side wall guide parts 54 connected to each of first side plate parts 53. Each side wall guide part 54 includes slide guide 54*f* extending in the sliding direction of second protruding end part 122 and guide inner side plate part 54*c* extending in a direction orthogonal to the sliding direction. Second protruding end parts 122 stop sliding when cutout parts 154*c* engaged with slide guides 54*f* abut to guide inner side plate parts 54*c*. Moreover, each side wall guide part 54 further includes lock latching recess 54*g* formed on the connection portion of slide guide 54*f* and guide inner side plate part 54*c*. When abutting to guide inner side plate parts 54*c*, cutout parts 154*c* are latched in lock latching recesses 54*g*. Consequently, the sliding of second protruding end parts 122 to the opposite direction is securely prevented, and it is prevented that the mating state of first connector 1 with second connector 101 is released.

Furthermore, one first reinforcing bracket 51 further includes side plate extension parts 53*a* extending each of first side plate parts 53, and stopper members 55*d* are connected to each of side plate extension parts 53*a*. Because stopper members 55*d* are connected to each of left and right side plate extension parts 53*a* in this manner, the posture of second protruding end parts 122 is stable even when counterforce in the reverse mating direction is received from stopper members 55*d* when second protruding end parts 122 are mated with first protruding end parts 21.

Next, a second embodiment will be described. Note that the description of objects having the same structures as those of the first embodiment will be omitted by being denoted by the same reference numerals. Furthermore, the description of operations and effects that are the same as those of the first embodiment will be omitted.

Figure 12A:
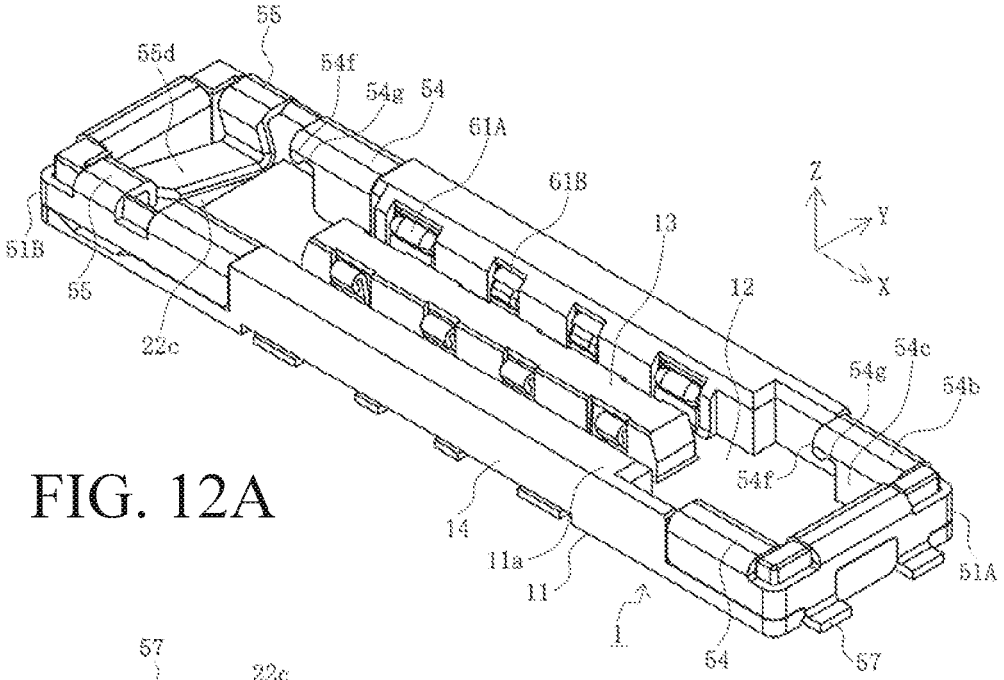
Figure 12B:
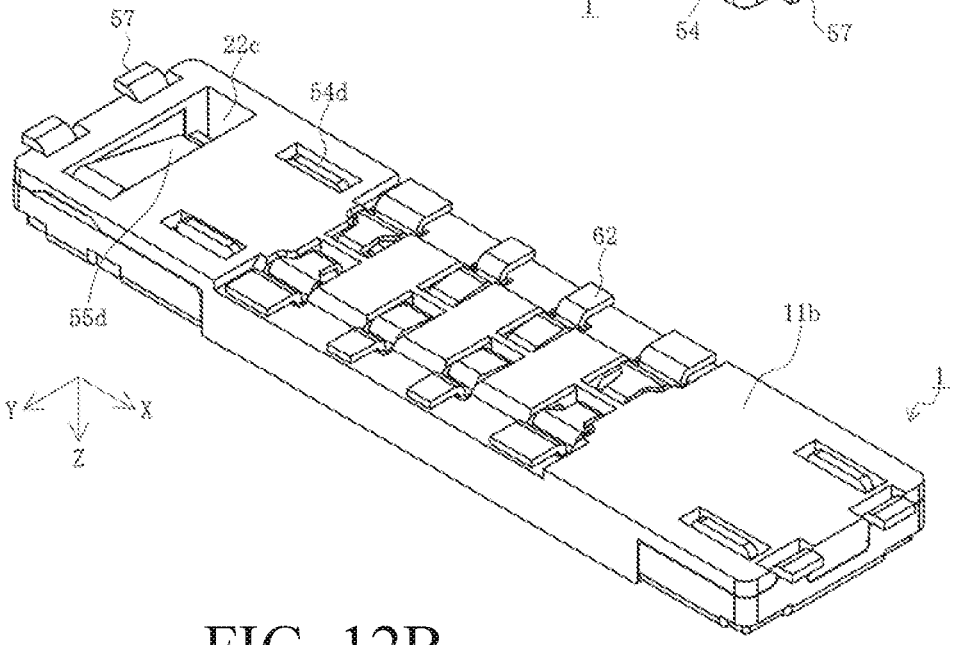
Figure 13:
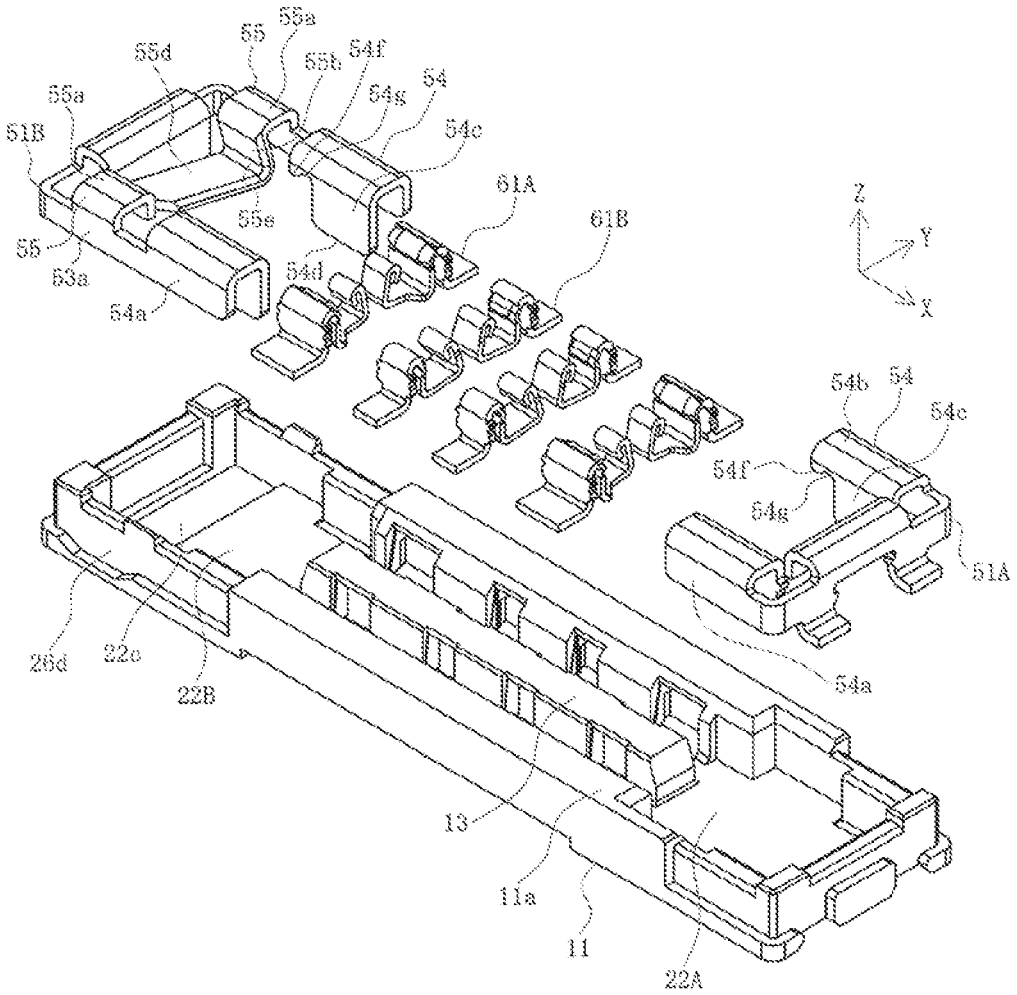
FIG. 13 is an exploded view of the first connector according to the second embodiment.
Figure 14:
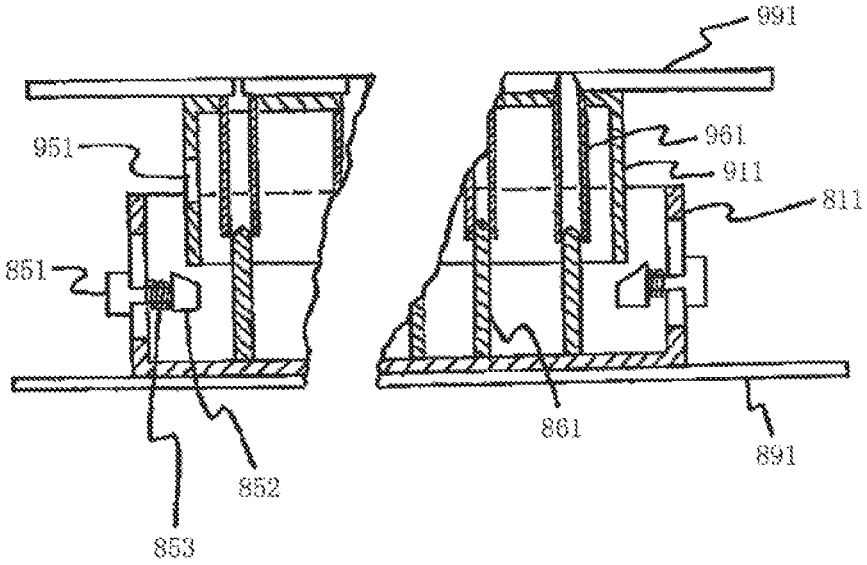
FIG. 14 Prior Art
FIG. 14 is a partial cross-sectional view of a conventional connector.

FIGS. 12A and 12B are perspective views of the first connector according to the second embodiment, and FIG. 13 is an exploded view of the first connector according to the second embodiment. Note that, FIG. 12A is a view from the mating face side and FIG. 12B is a view from the mounting face side.

In the present embodiment, stopper holding part 55 is connected to each top end of the pair of left and right side plate extension parts 53*a* contained in first reinforcing bracket 51B of first connector 1. However, while one stopper holding part 55 does have stopper member 55*d*, the other stopper holding part 55 does not have stopper member 55*d*. That is, one stopper holding part 55 has, similarly to the first embodiment, upper curved part 55*a* the proximal end of which is connected to the top end of side plate extension part 53*a* and which is curved in such a manner that the distal end is oriented downward on the inner side of mating recess 22, flat plate-shaped side arm part 55*b* which is connected to the bottom end of this upper curved part 55*a* and extends downward on the inner side of wide-width inner wall face 22*a*1, and cantilever-like flat plate-shaped stopper member 55*d* connected to the bottom end of this side arm part 55*b* with lower curved part 55*e* therebetween. In contrast, the other stopper holding part 55 does have upper curved part 55*a*, but nothing is connected to the bottom end of upper curved part 55*a*.

In an initial state in which no load is applied, stopper holding part 55 has, similarly to embodiment 1, a shape such that the distal end of stopper member 55*d* is oriented obliquely upward, and a part of lower curved part 55*e* is stored in lock storing recess 22*c*, but the major portion including the distal end of stopper member 55*d* is positioned above lock storing recess 22*c* in a position higher than the top face of bottom plate part 11*c* in mating recess 22B. Stopper holding part 55 is a member having spring properties, and when a downward load is applied from above to stopper member 55*d*, stopper holding part 55 elastically deforms, and thereby the entirety of stopper member 55*d* is stored in lock storing recess 22*c*.

Further, the dimensions of stopper member 55*d* related to the width direction of first housing 11 are larger than those of stopper members 55*d* in the first embodiment, but set to a level such that there is no contact with the surrounding of lock storing recess 22*c* even in a state in which a load is applied and the entirety of stopper member 55*d* is stored in lock storing recess 22*c*.

Note that descriptions of configurations and operations of other aspects of first connector 1, and of configurations and operations of second connector 101, that are the same as the first embodiment will be omitted.

In this manner, in the present embodiment, one first reinforcing bracket 51 further includes side plate extension parts 53*a* extending each of first side plate parts 53, and stopper member 55*d* is connected to one of side plate extension parts 53*a*. Consequently, since stopper member 55*d* is present only on either the left or the right side, it is possible to set the dimensions of stopper member 55*d* related to the width direction of first housing 11 so as to be large, and thereby it is possible to increase the displacement amount of the distal end of stopper member 55*d* in the mating direction, thus increasing the amount by which the distal end of stopper member 55*d* rises from the top face of bottom plate part 11*c*. As a result, it is possible to latch second protruding end part 122 more securely.

Note that the present disclosure is only one example, and thus any appropriate change that preserves the gist of the present disclosure and can easily be conceived of by a person skilled in the art is within the scope of the present disclosure. The widths, thicknesses, and shapes of the portions illustrated in the drawings are illustrated schematically and are not intended to limit the interpretation of the present disclosure.

Further, the disclosures of the present description set out characteristics related to preferred and exemplary embodiments. Various other embodiments, modifications and variations within the scope and spirit of the claims appended hereto could naturally be conceived of by a person skilled in the art by summarizing the disclosures of the present description.

The present disclosure can be applied to a connector and a connector assembly.

The invention claimed is:

1. A connector comprising a connector body, terminals mounted to the connector body, and reinforcing brackets mounted to each of two ends in a longitudinal direction of the connector body, wherein:

the connector body includes mating guide parts formed on the two ends in the longitudinal direction, the parts mating configured to mate with counterpart mating guide parts formed on two ends in the longitudinal direction of a counterpart connector body of a counterpart connector;

each of the reinforcing brackets includes a pair of left and right slide guides disposed on the mating guide part which are configured to engage with a pair of left and right slide engagement parts of a counterpart reinforcing bracket mounted to the counterpart mating guide part, only one of the reinforcing brackets including a receiving member;

the receiving member is configured to submerge when the counterpart mating guide part mates with the mating guide part; and the receiving member is configured to emerge and latch the counterpart mating guide part when the slide engagement part engages with the slide guide and the counterpart mating guide part slides on the mating guide part in the longitudinal direction relative to the mating guide part.

2. The connector according to claim 1, wherein the receiving member is a cantilevered flat plate, and the mating guide part comprises a receiving-member storing recess from and in which the receiving member can emerge and submerge.

3. The connector according to claim 2, wherein the receiving member is capable of elastically deforming in a mating direction, and when the counterpart mating guide part is mated with the mating guide part, the receiving member receives force in the mating direction applied by the counterpart mating guide part and submerges in the receiving-member storing recess, and when the force in the mating direction is released, at least a free end thereof protrudes from the receiving-member storing recess toward a reverse mating direction.

4. The connector according to claim 1, wherein: each of the reinforcing brackets comprises a pair of side plate parts extending in the longitudinal direction of the connector body, and a pair of side wall guide parts connected to each of the side plate parts;

each of the side wall guide parts comprises a slide guide extending in the longitudinal direction of the counterpart mating guide part, and a slide stopping part extending in a direction orthogonal to the longitudinal direction; and the counterpart mating guide part being configured to stop sliding when the slide engagement part engaged with the slide guide abuts against the slide stopping part.

5. The connector according to claim 4, wherein each of the side wall guide parts further comprises a latching recess formed on the connection portion of the slide guide and the slide stopping part, and, when abutting against the slide stopping part, the slide engagement part is latched in the latching recess.

6. The connector according to claim 4, wherein one of the reinforcing brackets further comprises side plate extension parts extending each of the side plate parts, and the receiving members are connected to each of the side plate extension parts.

7. The connector according to claim 4, wherein one of the reinforcing brackets further comprises side plate extension parts extending each of the side plate parts, and the receiving member is connected to one of the side plate extension parts.

8. A connector assembly comprising the connector according to claim 1, and a counterpart connector;

the counterpart connector including a counterpart connector body having counterpart mating guide parts formed on the two ends in the longitudinal direction and having counterpart reinforcing brackets mounted;

the counterpart mating guide parts mating with the mating guide parts of the connector; and the counterpart reinforcing brackets having a pair of left and right slide engagement parts.

9. A connector comprising: a connector body extending in a longitudinal direction and having first and second ends, the connector body having a first mating guide part formed at the first end, the connector body having a second mating guide part formed at the second end, the connector body having a lock storing recess provided proximate to the first end; terminals mounted in the connector body; a first reinforcing bracket attached to the first mating guide part, the first reinforcing bracket having a receiving member, the receiving member being movable between a normal position and a load position, wherein in the normal position at least a portion of the receiving member is not stored in the lock storing recess, and wherein in the load position an entirety of the receiving member is stored in the lock storing recess; and wherein upon a mating connector being mated with and locked to the connector, the mating connector is first moved in a mating direction relative to the connector and places a load on the receiving member to move the receiving member from the normal position to the load position, and the mating connector is second moved in the longitudinal directing relative to the connector to release the load on the receiving member to move the receiving member from the load position to the normal position, whereby the receiving member thereby locks the mating connector in place.

10. A method of connecting a first connector to a second connector, the method comprising the steps of:

(a) preparing the first connector further comprising the steps of: extending a connector body in a longitudinal direction and having first and second ends, the connector body having a first mating guide part formed at the first end, the connector body having a second mating guide part formed at the second end, the connector body having a lock storing recess provided proximate to the first end: mounting terminals in the connector body: attaching a first reinforcing bracket to the first mating guide part, the first reinforcing bracket having a receiving member, the receiving member being movable between a normal position and a load position, wherein in the normal position at least a portion of the receiving member is not stored in the lock storing recess, and wherein in the load position an entirety of the receiving member is stored in the lock storing recess;

(b) moving the second connector toward the first connector in a first direction to cause the receiving member of the first connector to move from the normal position to the load position;

(c) moving the second connector relative to the first connector in a second direction to cause the receiving member of the first connector to move from the load position to the normal position, wherein the second direction is orthogonal to the first direction, and wherein when the receiving member of the first connector moves from the load position to the normal position, the receiving member of the first connector locks the second connector in place relative to the first connector.

* * * * *